US010760875B2

(12) United States Patent
Zhang

(10) Patent No.: US 10,760,875 B2
(45) Date of Patent: Sep. 1, 2020

(54) REPLACEMENT BUTTSTOCK FOR RIFLE

(71) Applicant: Hong Jun Zhang, City of Industry, CA (US)

(72) Inventor: Hong Jun Zhang, City of Industry, CA (US)

(73) Assignee: Trinity Force Corporation (USA), City of Industry, CA (US)

( * ) Notice: Subject to any disclaimer, the term of this patent is extended or adjusted under 35 U.S.C. 154(b) by 0 days.

(21) Appl. No.: 16/212,647

(22) Filed: Dec. 6, 2018

(65) Prior Publication Data

US 2020/0182586 A1 Jun. 11, 2020

(51) Int. Cl.
*F41C 23/14* (2006.01)
*F41C 23/04* (2006.01)

(52) U.S. Cl.
CPC ..... *F41C 23/14* (2013.01); *F41C 23/04* (2013.01)

(58) Field of Classification Search
CPC ..... F41C 23/04; F41C 23/14
USPC ..... 42/73
See application file for complete search history.

(56) References Cited

U.S. PATENT DOCUMENTS

| | | | | |
|---|---|---|---|---|
| 7,748,370 | B1 * | 7/2010 | Choma | F41B 5/12 124/25 |
| 7,762,018 | B1 * | 7/2010 | Fitzpatrick | F41A 11/02 42/73 |
| 8,631,601 | B2 * | 1/2014 | Langevin | F41C 23/14 42/73 |
| 8,950,099 | B2 * | 2/2015 | Rogers | F41C 23/04 42/71.01 |
| 9,746,281 | B2 * | 8/2017 | Wilson | F41C 23/04 |
| 2006/0254111 | A1 * | 11/2006 | Giauque | F41C 23/04 42/72 |
| 2018/0080736 | A1 * | 3/2018 | Olsen | F41C 23/04 |
| 2019/0137213 | A1 * | 5/2019 | Miller | F41A 3/84 |

* cited by examiner

*Primary Examiner* — Stephen Johnson
*Assistant Examiner* — Benjamin S Gomberg
(74) *Attorney, Agent, or Firm* — Raymond Y. Chan; David and Raymond Patent Firm

(57) ABSTRACT

A replacement buttstock includes a stock body and a locking lever assembly. The stock body has an elongated receiving chamber for receiving a connecting extension of a rifle. The locking lever assembly includes a lever element, a locking pin, a stopper element and a restoring element. The stopper element is operated to allow the lever element to move to an unlock state in which the locking pin is driven to move out of the receiving chamber for unlocking the connecting extension, so that the buttstock is convenient and easy to be quickly assembled with and detached from the rifle while the user does not have to change his or her original aiming gesture.

1 Claim, 16 Drawing Sheets

A-A

B-B

C-C

REPLACEMENT BUTTSTOCK FOR RIFLE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a buttstock for a gun, and more particularly to a replacement buttstock which is adapted for being easy to assembly with and detach from a rifle.

Description of Related Arts

A buttstock, which is also known as a shoulder stock, a stock or a butt, is a rear part of a rifle. During usage, the buttstock is held to bias against a user's shoulder, so that the backlash vibration generated in a shooting operation can be evenly transmitted to the user's body, and thus the user's body will not be easy to get hurt in the backlash movement of the rifle. In addition, since the buttstock provides a support to the rifle, it also enhances the stability when aiming and shooting, so as to increase the shooting accuracy.

The buttstock can be a fixed part of the rifle, but a collapsible buttstock is more comfortable to use. It has the ability to be used as a long, fixed stock for controlled, accurate firing. It also can be adjusted to fit the individual shooters, thus making the shooter as comfortable as possible when shooting. When in not use, the collapsible buttstock can be disassembled from the rifle, so that the total length of the firearm is reduced, and the rifle is easier to store when the user is travelling. What's more, a collapsible buttstock can be assembled with a new rifle, helping the user to save costs. In other words, the user may create a collection of different types of rifles which can be detachably assembled with the same collapsible buttstock.

However, the conventional collapsible buttstock is not convenient to assemble or disassemble, it is time and effort consuming before the shooter is ready for shooting. FIG. 1 of the drawings shows a typical conventional collapsible buttstock which includes a butt body 1 and a locking lever arrangement 2. When removing the collapsible buttstock from a rifle having a connecting barrel 3, the user has to use one hand to hold firmly to an upper portion of the rifle, and then use another hand to grasp the entire locking lever arrangement and pull it away from the butt body so as to fully retract the lever lock pin which has been inserted into a chamber of the butt body 1 for locking the connecting barrel 3, and then sliding the buttstock backward to disengage with the barrel of the rifle. To install the collapsible buttstock, similarly, the user has to use one hand to hold firmly to the upper portion of the rifle, and then use another hand to pull the locking lever arrangement 2 away from the butt body 1 for enabling the connecting barrel 3 to slide into the chamber of the butt body 1. Actually, the removal or installation of the collapsible buttstock requires a great effort in the pulling and pressing process, so that it is often accomplished by fixing the rifle in a gunsmith's rifle vice or fixture. In an alternative mode of the conventional firearm with the rifle and the collapsible buttstock, the user may have to user two hands to operate on the lock lever arrangement 2. For example, the user has to use fingers of two hands to press an end of the lock lever arrangement 2 to an utmost position for displacing the lock lever pin.

It is thus can be seen that the conventional collapsible buttstock is disadvantageous in that the user cannot quickly the remove or install the conventional collapsible buttstock during usage. Particularly, when a user is holding on the rifle with a desired aiming gesture, he or she has to change his or her original holding gesture if he or she wants to assemble or disassemble the buttstock. For example, when the user uses his or her two hands to hold on the rifle in a desired ready to shoot position, if he or she wants to install the collapsible buttstock on the rifle, he or she has to move one hand which is holding on a clip at a bottom side of the rifle to a position holding the upper side of the rifle and simultaneously use the other hand to operate on the locking lever arrangement 2 for allowing the connecting barrel 3 to be inserted into the chamber of the butt body 1, and then the user needs an additional step for adjusting his or her hands to find the desired holding position for shooting. Otherwise, if the user wants to maintain the holding position of his or her right hand on the clip of the rifle and use another hand to pull the locking lever arrangement 2, the pulling force will actually tend to drive the buttstock to rotate with respect to the holding position of his or her right hand on the rifle, and thus resulting in a failure for pulling out the locking lever pin of the locking lever arrangement 2. As another example, when the user is holding on the rifle and aiming at a desired shooting direction, but there is a limited room and space for the shooter to hide the rifle and to hide himself or herself, it is impossible for him or her to remove the collapsible buttock while maintaining the holding position and the shooting direction. In addition, in a situation requires a quick shooting response, the user cannot immediately use one hand to adjust the aiming position while simultaneously use anther hand to assemble the collapsible buttstock to the rifle, instead, he or she has to install the buttstock on the rifle with his or her two hands before aiming and shooting.

SUMMARY OF THE PRESENT INVENTION

The invention is advantageous in that it provides a replacement buttstock for rifle, wherein the replacement buttstock is convenient and easy to be quickly assembled with and detached from the rifle.

Another advantage of the invention is to provide a replacement buttstock for rifle, wherein a user does not have to change his or her original holding gesture if he or she wants to assemble or disassemble the replacement buttstock while holding on the rifle with a maintained aiming gesture.

Another advantage of the invention is to provide a replacement buttstock for rifle, wherein the user is capable of quickly getting ready for shooting by adjusting the holding position and gesture of the rifle while simultaneously assemble the replacement buttstock with the rifle.

Another advantage of the invention is to provide a replacement buttstock for rifle, wherein it only requires a single hand of the user to operate on a locking lever assembly of the replacement buttstock for enabling a connecting extension of the rifle to be inserted into or slid out from a receiving chamber of the replacement buttstock.

Another advantage of the invention is to provide a replacement buttstock for rifle, wherein unlike the pulling mechanism of the conventional collapsible buttstock for vertically moving the locking lever arrangement, only a convenient operation on the locking lever assembly with a relatively few effort is required for enabling a rotating movement of a lever element of the locking lever assembly for displacing a locking pin so as to release the connecting extension of the rifle.

Another advantage of the invention is to provide a replacement buttstock for rifle which enables the user to use his or her different fingers of a single hand to cooperatively operate on the lever element and a stopper element of the locking lever assembly respectively for assembling or disassembling the rifle with the replacement buttstock.

Another advantage of the invention is to provide a replacement buttstock for rifle, wherein the user only has to press or pull the stopper element for providing a moving space for the lever element and a press operation on a proximal end portion of the lever element of the locking lever assembly of the replacement buttstock will enable a rotating movement of the lever element for driving the locking pin at a distal end portion of the lever element to move into or get out from the receiving chamber of the replacement buttstock so as to slid in or slide out the connecting extension of the rifle for assembling or disassembling the replacement buttstock with the rifle.

Another advantage of the invention is to provide a replacement buttstock for rifle, wherein the locking lever assembly can be operated for disengaging the locking pin with the connecting extension so as to adjust the engaging position of the connecting extension with the locking pin for fitting the individual shooters by adjusting a distance between the rifle and a shoulder of the shooter, thus making the shooter feel comfortable when shooting.

Another advantage of the invention is to provide a replacement buttstock for rifle, wherein when pressing on the lever element of the locking lever assembly for adjusting the assembling position of the connecting extension of the rifle, the stopper element prevents the further movement of the lever element so as to prevent the connecting extension of the rifle from sliding out from the receiving chamber of the replacement buttstock.

Another advantage of the invention is to provide a replacement buttstock for rifle, wherein after the operation on the locking lever assembly for assembling or disassembling the replacement buttstock with the rifle, the locking lever assembly will automatically restore its original position immediately after the user releases his or her hand on the locking lever assembly.

Another advantage of the invention is to provide a replacement buttstock for rifle, wherein the structure of the replacement buttstock is not complicated and also is easy for manufacturing to save costs.

Additional advantages and features of the invention will become apparent from the description which follows, and may be realized by means of the instrumentalities and combinations particularly pointing out in the appended claims.

According to the present invention, the foregoing and other objects and advantages are attained by a replacement buttstock for a rifle including a connecting extension, wherein the replacement buttstock comprises a stock body and a locking lever assembly coupled to the stock body. The stock body has an elongated receiving chamber for receiving a connecting extension of a rifle. The locking lever assembly includes a lever element, a locking pin connected to the lever element for retaining the connecting extension in the receiving chamber of the stock body, a stopper element arranged for being operated to allow the lever element which is being pressed to move to an unlock state in which the locking pin is driven to move out of the receiving chamber of the stock body by the lever element for unlocking the connecting extension and a restoring element restoring element for restoring the lever element when the lever element is released.

The present invention further provides a method for assembling a replacement buttstock with a rifle including a connecting extension, wherein the method comprises the following steps.

(a) Displace a stopper element for allowing a movement of a lever element when the stopper element is operated.

(b) Drive an engaging end portion of a locking pin to move out of a receiving chamber of a stock body by the lever element when the lever element is pressed.

(c) Receive the connecting extension of the rifle in the receiving chamber of the stock body.

(d) Restore the stopper element and the lever element to insert the engaging end portion of the locking pin into the receiving chamber of the stock body and retain the connecting extension of the rifle in the receiving chamber of the stock body by the locking pin when the stopper element and the lever element is released.

The present invention further provides a method for disassembling a replacement buttstock with a rifle including a connecting extension, wherein the method comprises the following steps.

(A) Displace a stopper element for allowing a movement of a lever element when the stopper element is operated.

(B) Drive the engaging end portion of the locking pin to move out of a receiving chamber of a stock body when the lever element is pressed.

(C) Disengage a locking pin with the connecting extension of the rifle for allowing the connecting extension of the rifle to be slid out of the receiving chamber of the stock body.

The present invention further provides a method for adjusting an assembling position of a connecting extension of a rifle in a receiving chamber of a stock body of a replacement buttstock, wherein the method comprises the following steps.

(α) Disengage a locking pin with a first retaining groove of the connecting extension of the rifle which is received in the receiving chamber of the stock body in a first assembling position when a lever element is moved to displace the locking pin.

(β) Stop a further movement of the lever element by a stopper element for preventing the locking pin to be moved out of the receiving chamber of the stock body.

(γ) Engage the locking pin with a second retaining groove of the connecting extension of the rifle by restoring the lever element to reposition the locking pin after the connecting extension of the rifle is slid in the receiving chamber of the stock body to a second assembling position which aligns the locking pin with the second retaining groove of the connecting extension of the rifle.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. that indicate relations of directions or positions are based on the relations of directions or positions shown in the appended drawings, which are only to facilitate descriptions of the present invention and to simplify the descriptions, rather than to indicate or imply that the referred device or element is limited to the specific direction or to be operated or configured in the specific direction. Therefore, the above-mentioned terminologies shall not be interpreted as confine to the present invention.

Figure 9A:
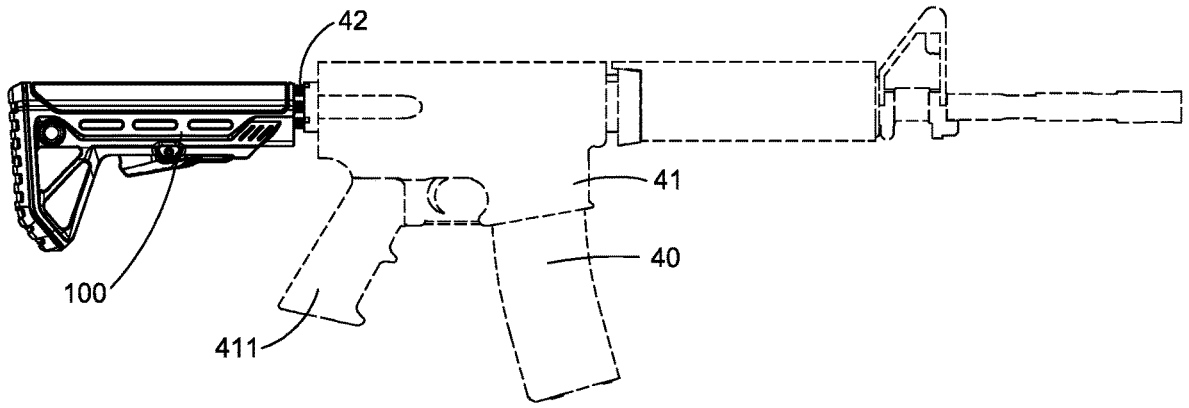
FIG. 9A is a schematic view illustrating a rifle being assembled with replacement buttstock according to the above first preferred embodiment of the present invention.

Referring to FIG. 1 to FIG. 12F of the drawings, a replacement buttstock 100 according to a first preferred embodiment of the present invention is illustrated. The replacement buttstock 100 of this preferred embodiment comprises a stock body 10, a locking lever assembly 20 coupled to the stock body 10, and a stock pad 30 connected to the stock body 10. The replacement buttstock 100 is adapted for being assembled with or disassembled with a rifle 40 which comprises a rifle body 41 and a connecting extension 42 connected the rifle body 41 for detachably coupling with the replacement buttstock 100. The connecting extension 42 can be integrally extended from the rifle body 41 or is installed with the rifle body 41, as is shown if FIG. 9A of the drawings.

The rifle 40 of the present invention, which is a typical portable long-barrelled firearm designed for precision shooting, is to be held with both hands and braced against a shoulder of a user with the aid of the replacement buttstock 100 for stability during firing and shooting. The rifle 40 can be a firearm used in warfare, hunting and shooting sports, or is just a toy gun for entertainment of the user.

The stock body 10 has an elongated receiving chamber 101 at an upper side thereof for engaging with the connecting extension 42 of the rifle 40, the locking lever assembly 20 is adapted for being operated to lock or unlock the connecting extension 22 in the receiving chamber 101 of the stock body 10. The stock pad 30 comprises a pad body 31 and one or more connecting element 32 for connecting the pad body 31 to a rear end portion of the stock body 10. The pad body 31, which is preferably made of resilient material such as rubber, is biasing against the shoulder of the user during shooting for evenly distributing the backlash vibration to the shoulder of the user.

More specifically, by operation on the locking lever assembly 20, the connecting extension 42 of the rifle 40 can be inserted into the receiving chamber 101 of the stock body 10 and be retained in the receiving chamber 101 of the stock body 10, the connecting extension 42 of the rifle 40 is then connected with the stock body 10 so as to assemble the rifle 40 with the replacement buttstock 100. The connecting extension 42 of the rifle 40 also can be released and pulled out from the receiving chamber 101 of the stock body 10 to disassemble the rifle 40 with the replacement buttstock 10.

Figure 9B:
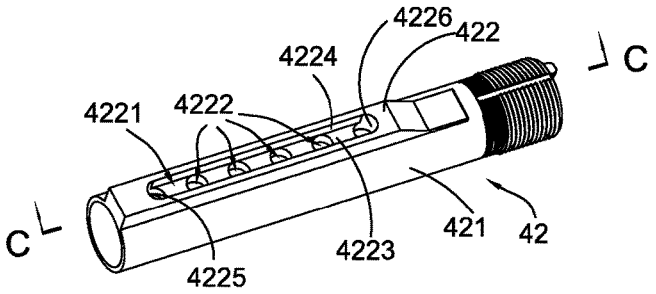
FIG. 9B is an enlarged perspective view of a connecting extension of the rifle for being engaged with the replacement buttstock according to the above first preferred embodiment of the present invention.
Figure 9C:
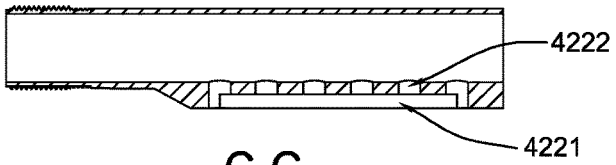
FIG. 9C is a sectional view along line C-C of FIG. 9B.
Figure 10:
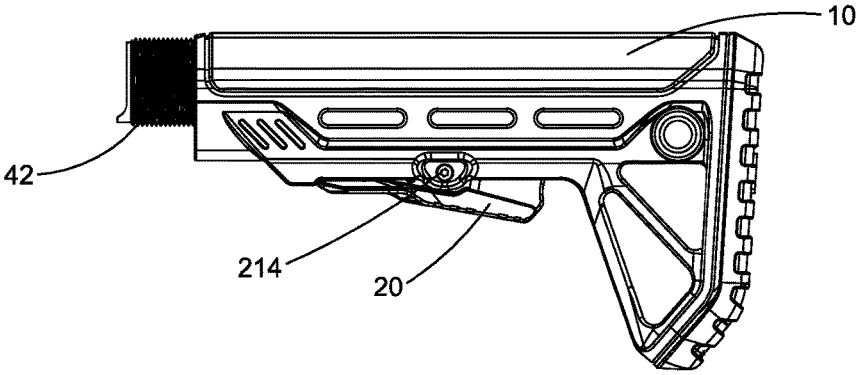
FIG. 10 is a schematic view illustrating the connecting extension being assembled with the replacement buttstock according to the above first preferred embodiment of the present invention.
Figure 11D:
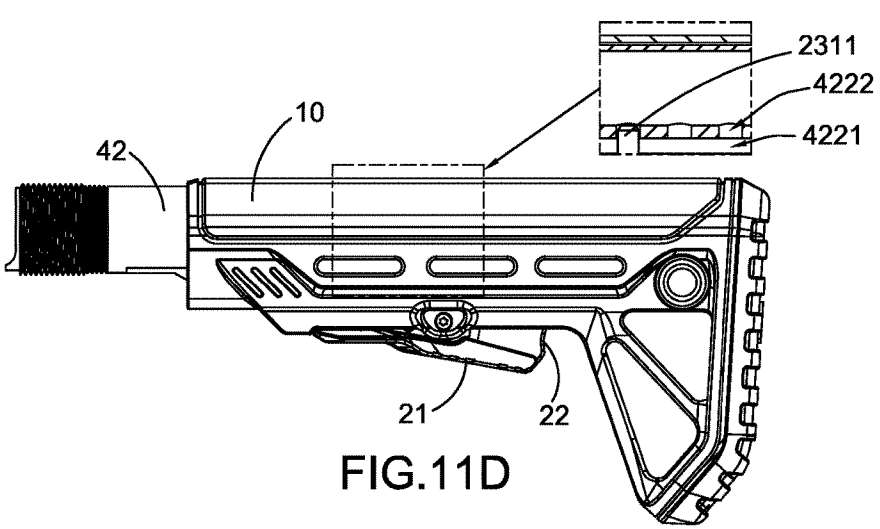
FIGS. 11A, 11B, 11C and 11D are schematic views illustrating the operation on the lever element for adjusting the engaging position of the connecting extension with a locking pin of the replacement buttstock according to the above first preferred embodiment of the present invention.
Figure 11C:
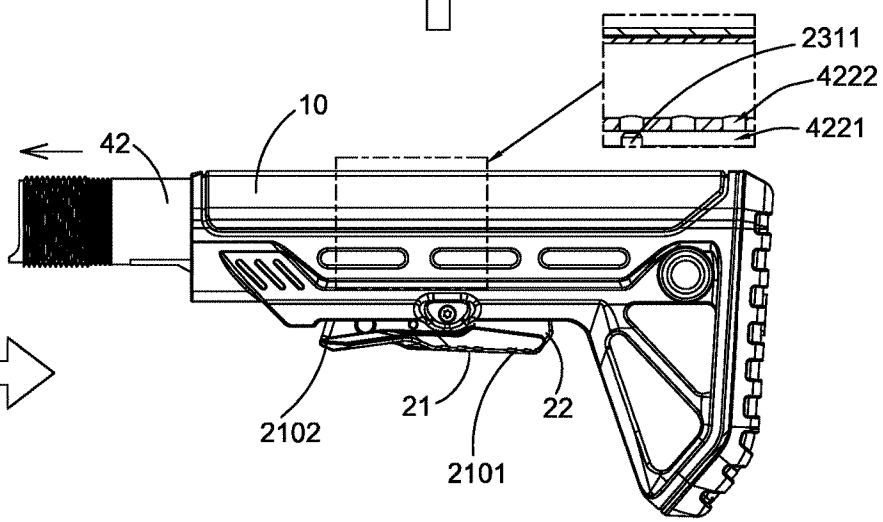
Figure 11A:
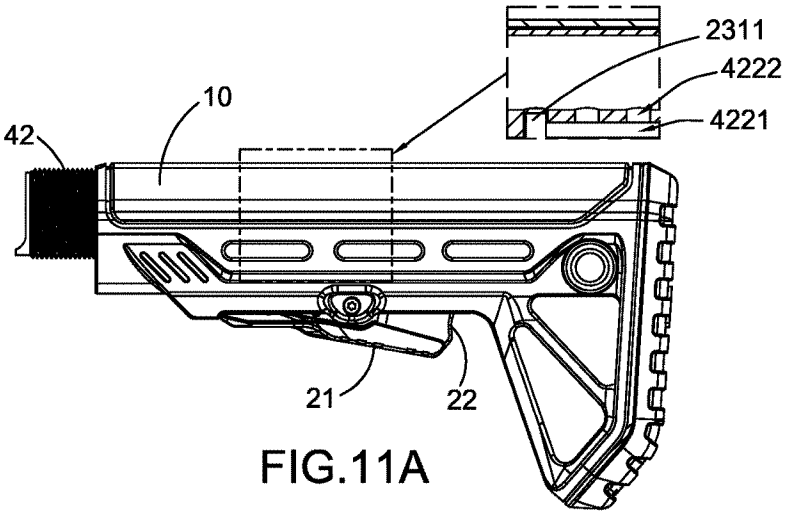
Figure 11B:
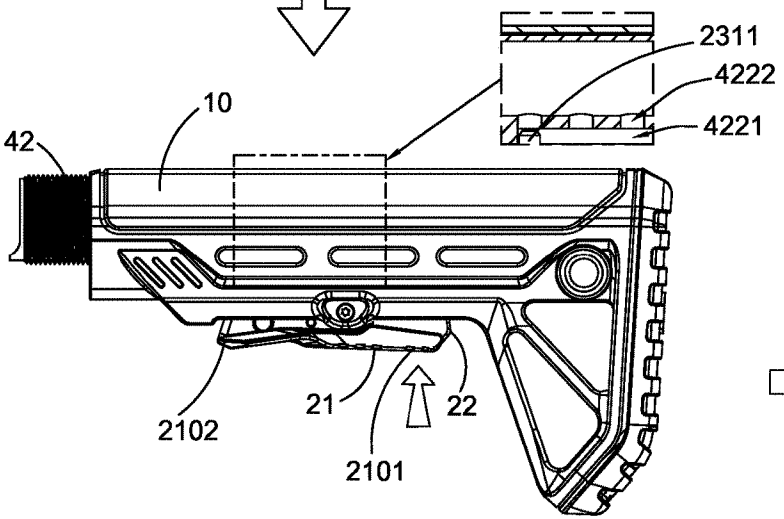

The connecting extension 42 of the rifle 40 comprises an elongated extension member 421 which can be a connecting barrel with a hollow structure, and an engaging member 422 integrally extended from or connected to a lower side of the extension member 421, as is shown in FIG. 9B of the drawings. The engaging member 422 has a sliding groove 4221 extended along a length thereof at a lower side of the engaging member 422, and a plurality of retaining grooves 4222 communicated to the sliding groove 4221. Accordingly, the engaging member 422 has an inner wall 4223, two spaced apart side walls 4224, two end walls which are a proximal end wall 4225 and a distal end wall 4226 extended from the two side walls 4224 to define the sliding groove 4221 therewithin, the plurality of retaining grooves 4222 are disposed in the inner wall 4223. The person of ordinary skilled in the art should understand that the retaining grooves 4222 may also be disposed in the extension member 421

Figure 4:
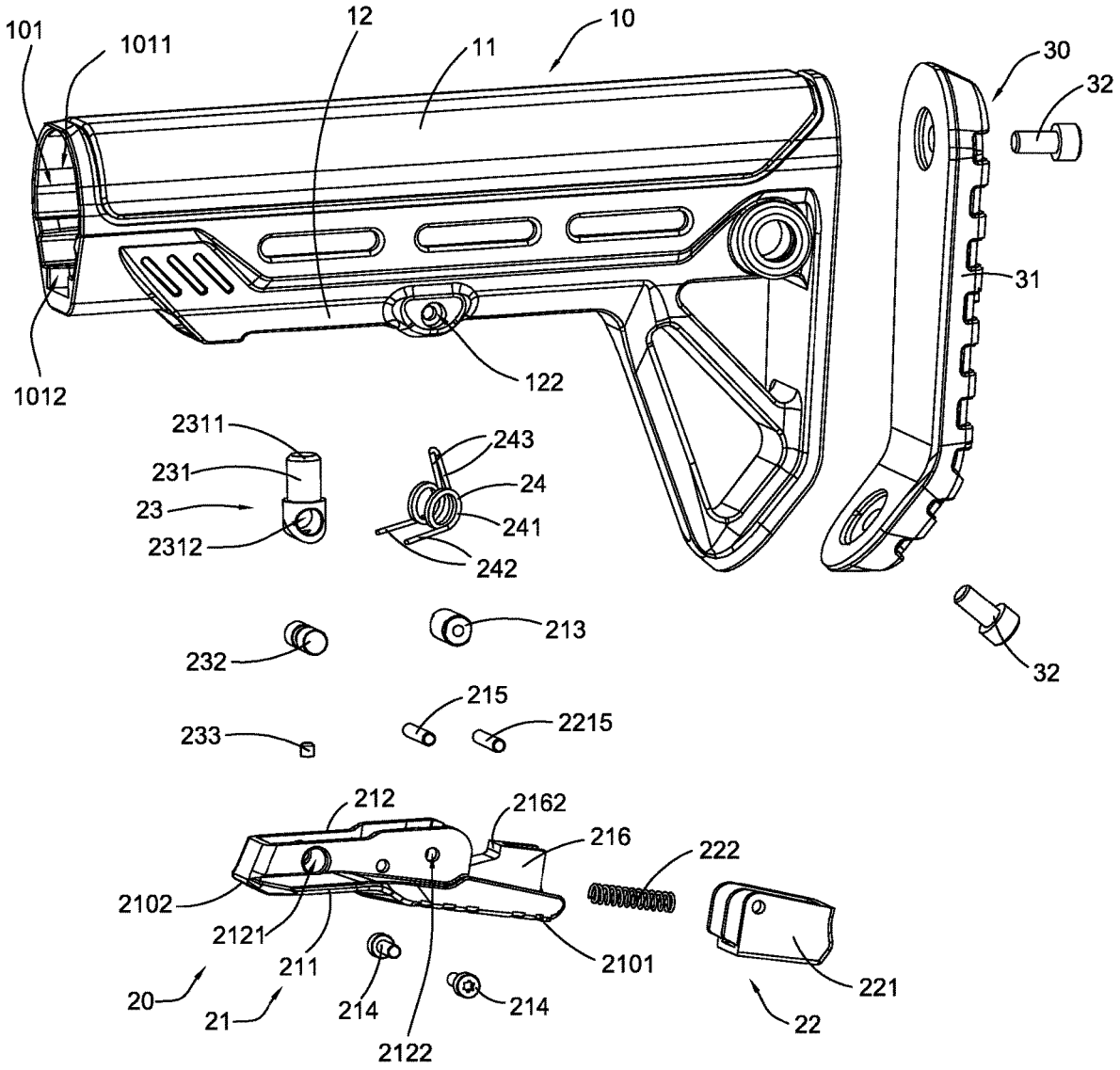
FIG. 4 is an exploded view of the replacement buttstock according to the above first preferred embodiment of the present invention.

Referring to FIG. 4 of the drawings, the locking lever assembly 20 comprises a lever element 21, a stopper element 22 a locking pin 23, and a restoring element 24. The locking pin 23 is adapted for engaging with one of the plurality of retaining grooves 4222 for retaining the connecting extension 42 within the receiving chamber 101 of the stock body 10. The lever element 21 can be pressed to drive the locking pin 23 to move so as to engage or disengage with one of the retaining grooves 4222 for locking or unlocking the connecting extension 42. More specifically, when the locking pin 23 is engaged with one of the retaining grooves 4222, by operating on the lever element 21 to drive the locking pin 23 connected to the lever element 21 to disengage with the one of the retaining grooves 4222, and then the connecting extension 42 can be slid in the receiving chamber 101 of the stock body 10 for adjusting the assembling position of the connecting extension 42, and the connecting extension 42 can be retained in the receiving chamber 101 of the stock body 10 by engaging the locking pin 23 with another retaining groove 4222. It is still worth mentioning that in an alternative example, a retaining groove 4222 may be formed in the locking pin 23, while the connecting extension 42 may be formed with a plurality of positioning protrusions for engaging with the retaining groove 4222 in the locking pin 23 for locking the connecting extension 42 in the receiving chamber 101 of the stock body 10.

It is worth mentioning that when only the lever element 21 is operated, the stopper element 22 is retained at its original position for stopping the further movement of the lever element 21 for preventing the locking pin 23 to be moved to a position allowing the connecting extension to be inserted into or slide out from the receiving chamber 101 of the stock body 10. In other words, when the stopper element is not moved, the lever element 21 can be moved to displace the locking pin 23 so as to allow the connecting extension 42 to slide in the receiving chamber 101 of the stock body 10 but cannot slide out from the receiving chamber 101 of the stock body 10. When both the stopper element 22 and the lever element 21 are moved, the locking pin 23 will not block the sliding movement of the connecting extension 42 so as to enable the connecting extension 42 to be inserted into or slide out from the receiving chamber 101 of the stock body 10, the mechanism will be discussed in detail in the following description.

Figure 3A:
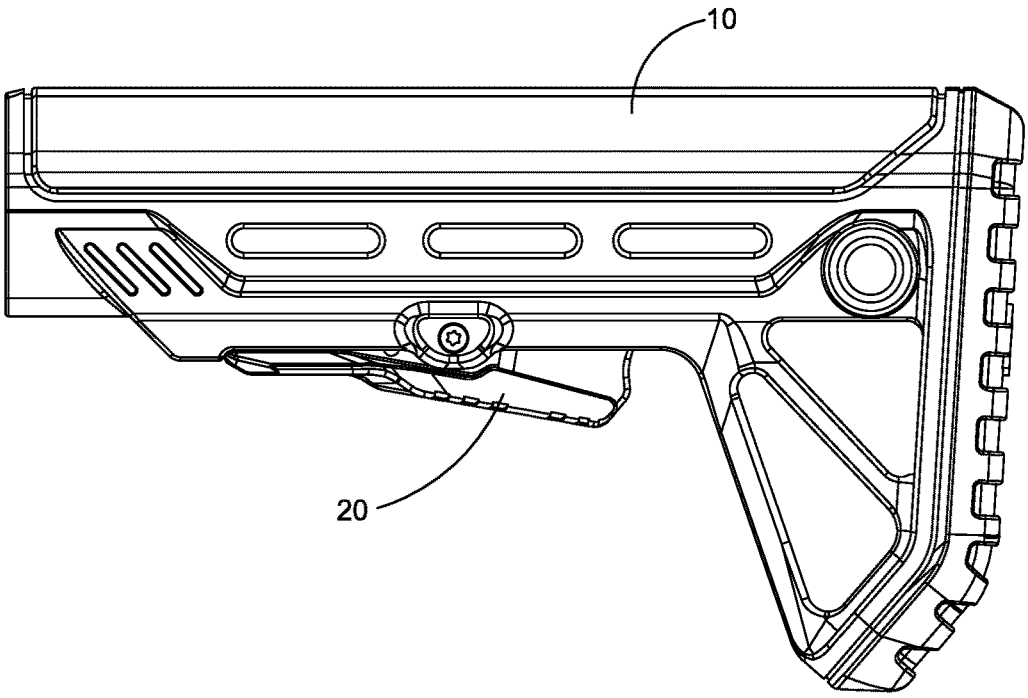
FIG. 3A is a side view of the replacement buttstock according to the above first preferred embodiment of the present invention.
Figure 3B:
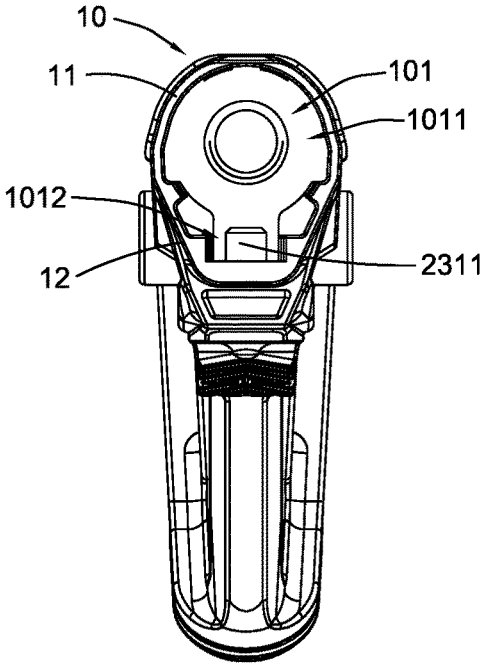
FIG. 3B is a front view of the replacement buttstock according to the above first preferred embodiment of the present invention.

The receiving chamber 101 of the stock body 10 has an upper accommodation chamber 1011 and a lower sliding chamber 1012 communicated with the upper accommodation chamber 1011, as is shown in FIG. 3 and FIG. 4 of the drawings. The accommodation chamber 1011 is sized and shaped to match with the extension member 421 of the connecting extension 42 while the sliding chamber 1012 is sized and shaped to match with the engaging member 422 of the connecting extension 42. Accordingly, the engaging ember 422 is capable of being slid in the sliding chamber 102 for adjusting the engaging position between the locking pin 23 and the retaining grooves 4222.

The lever element 21 has a proximal end portion 2101 and a distal end portion 2102, and the locking pin 23 is coupled to the distal end portion 2102 for engaging with one of the retaining grooves 4222 of the engaging member 42. When the proximal end portion 2101 of the lever element 21 is pressed, the locking pin 23 at the distal end portion 2102 of the lever element 21 can be actuated to move simultaneously.

The locking pin 23 comprises a pin body 231, a connector 232, and a fixing element 233. The lever element 21 comprises a base plate 211, and two mounting walls 212 extended from the base plate 211 respectively. The base plate 211 has a penetrating hole 2111, each of the two mounting walls 212 has a mounting hole 2121, the pin body 231 has an upper engaging end portion 2311 which is capable of being inserted into the sliding chamber 1012 and the sliding groove 4221, and can be further driven to be inserted into one of the retaining grooves 4222 for locking the connecting extension 42. The pin body 231 has a connecting hole 2312 at a lower portion thereof for the connector 232, which is retained at a position corresponding to the mounting holes 2121 of the two mounting walls 212, to penetrate therethrough for connecting the locking pin 23 with the lever element 21. The fixing element 233, which can be embodied as a stopping screw, is to firmly retain the connector 232 at the pin body 231 to enhance the connection therebetween. The bottom penetrating hole 2111 is formed for facilitating the assembling process of the connector 232.

Referring to FIGS. 4 to 6B of the drawings, the lever element 21 further comprises a rotation axle 213 and a pair of fixing members 214 for fixing the rotation axle 213 with the stock body 10. The lever element 21 is capable of rotating with respect to the rotation axle 231 which is located at a middle portion of the lever element 21. Accordingly, when the proximal end portion 2101 of the lever element 21 is pressed, the lever element 21 will rotate with respect to the rotation axle 231 to drive the pin body 231 of the locking pin 23 to disengage with the corresponding retaining groove 422, so that the connecting extension 42 of the rifle can be slid in the receiving chamber 101 of the stock body 10 by sliding the extension member 421 in the accommodation chamber 1011 and simultaneously sliding the engaging member 422 in the sliding chamber 1012, so as to align another retaining groove 4222 with the pin body 231 of the locking pin 23 and engage the another retaining groove 422 with the pin body 231 of the locking pin 23 for adjusting the assembling position of the connecting extension 42 with the replacement buttstock, thus adjusting a distance between a user's shoulder and the rifle 40 for enabling the user to find a comfortable holding gesture for the rifle 40.

It is worth mentioning that the stock body 10 comprises a receiving portion 11 defining the receiving chamber 101, and a mounting portion 12 extended at a bottom of the receiving portion 11 for mounting the locking lever assembly 20. The receiving portion 11 has a base inner wall 111 and a surrounding inner wall 112 defining the receiving chamber 101. Accordingly, when the proximal end portion 2101 of the lever element 21 is pressed, the lever element 21 will rotate with respect to the rotation axle 231 to drive the pin body 231 of the locking pin 23 to disengage with the corresponding retaining groove 422, but at the same time, the engaging end portion 2311 of the pin body 231 of the locking pin 23 is still penetrated and protruded from the base inner wall 111 of the receiving portion 11 of the stock body 10 and is extending in the sliding groove 4221 of the engaging member 422, so that the engaging end portion 2311 of the pin body 231 of the locking pin 23 can only be slid in the sliding groove 4221 of the engaging member 422 within the sliding chamber 1012 of the stock body 10, the proximal end wall 4225 and the distal end wall 4226 of the engaging member 422 will block the further sliding movement of the pin body 231 of the locking pin 23 in the sliding groove 4221 of the engaging member 422 for restricting the sliding path of the pin body 231 of the locking pin 23. Accordingly, the pin body 231 of the locking pin 23 is slid in the sliding groove 4221 of the engaging member 422 and can be biasing against the proximal end wall 4225 of the engaging member 422 to block the sliding movement of the connecting extension 42 of the rifle 40 in the receiving chamber 101 of the stock body 10 for preventing the connecting extension 42 of the rifle 40 to slide out from the receiving chamber 101 of the stock body 10.

When the lever element 21 is pressed to drive the locking pin 23 to produce a displacement, the restoring element 24 is deformed to generate a restoring energy, and when the lever element 21 is released, the restoring energy of the restoring element 24 will drive the lever element 21 to restore its original state.

Figure 1:
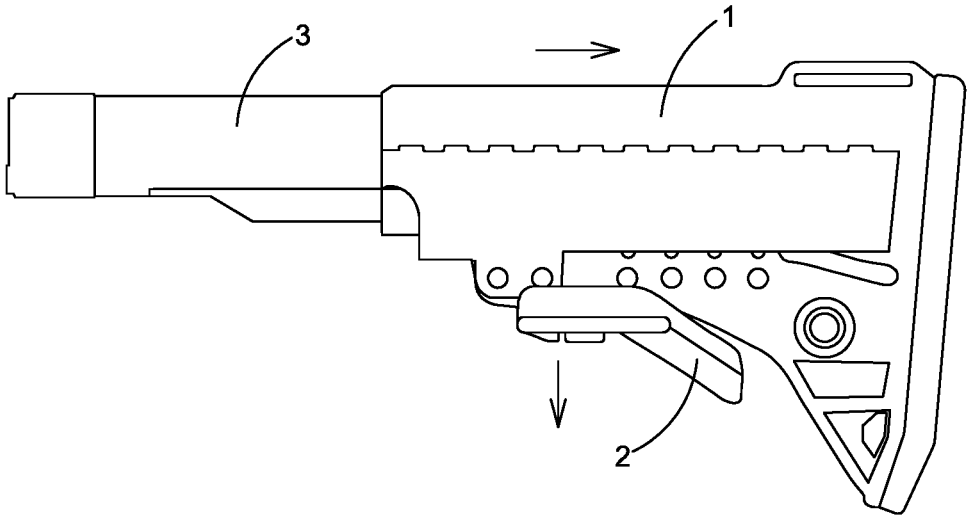
FIG.1 PRIOR ART
FIG. 1 is a schematic view illustrating a conventional collapsible buttstock.
Figure 2:
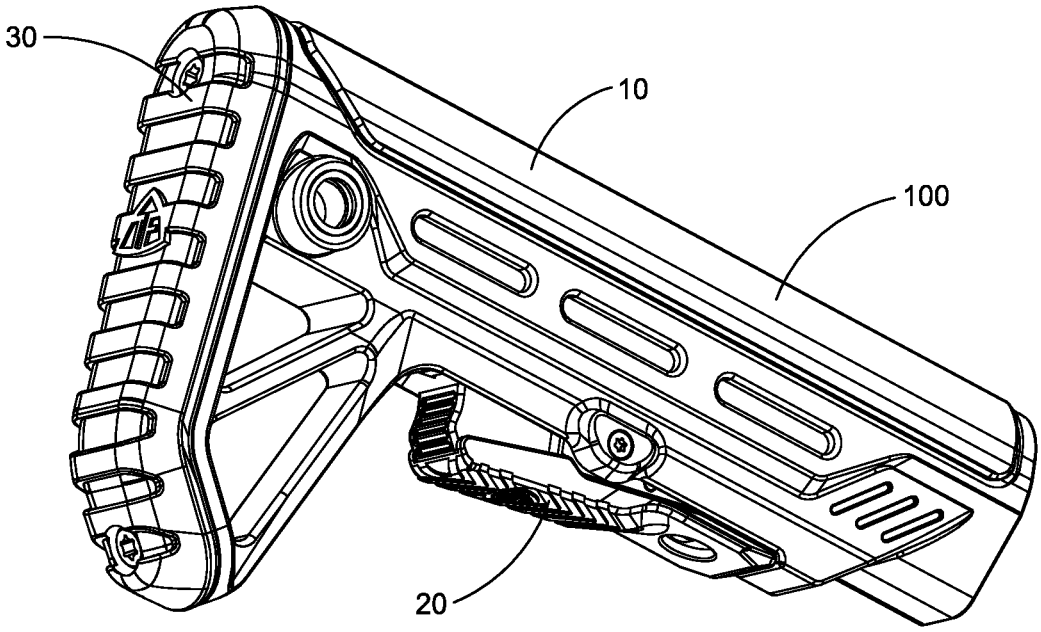
FIG. 2 is a perspective view of a replacement buttstock according to a first preferred embodiment of the present invention

According to this preferred embodiment of the present invention, the restoring element 24 can be a torsion spring, referring to FIG. 2 of the drawings, the torsion spring is actually embodied as a twins torsion spring comprises two spring coils 241, two free first biasing legs 242 extended from the two spring coils 241 respectively, and two second biasing legs 243 extended between the two spring coils 241 and are connected with each other to form an integral connecting leg which defines an acute angle with respect to the two free first biasing legs 242. The rotation axle 213 penetrates through the two spring coils 241. Accordingly, when the proximal end portion 2101 of the lever element 21 is pressed to drive the lever element 21 to rotate with respect to the rotation axle 213, the biasing legs 242 and 243 are pressed to reduce the acute angle between the first biasing legs 242 and the second biasing legs 243 to generate a resilient restoring power, and when the lever element 21 is released, the biasing legs 242 and 243 restores their original position to drive the lever element 21 to move to its original state.

In addition, in this preferred embodiment, the lever element 21 further comprise a retention member 215 connected between the two mounting walls 212 for fixing and retaining the two first biasing legs 242 in position.

Figure 5A:
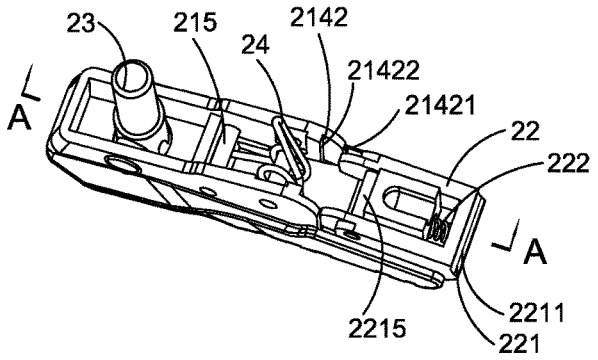
FIG. 5A is a perspective view of a locking lever assembly of the replacement buttstock according to the above first preferred embodiment of the present invention.
Figure 5B:
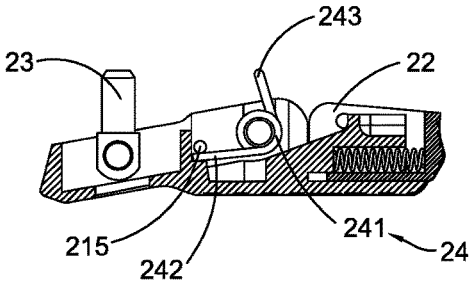
FIG. 5B is a sectional view along line A-A of FIG. 5A.
Figure 5C:
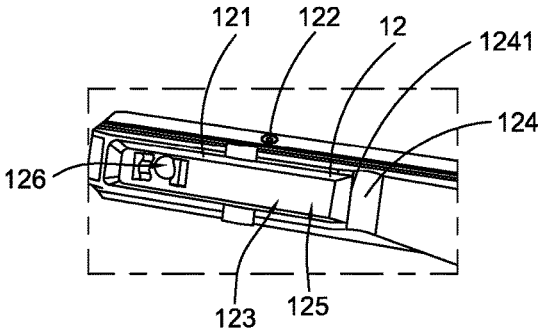
FIG. 5C is a schematic view illustrating a bottom structure of a stock body for engaging with the locking lever assembly of the replacement buttstock according to the above first preferred embodiment of the present invention.
Figure 6A:
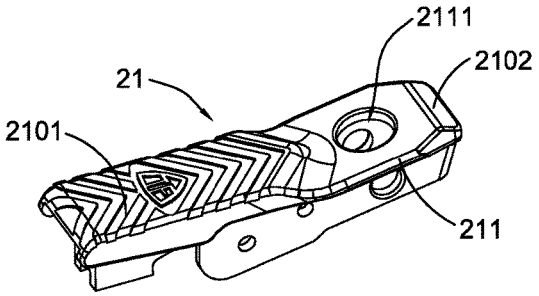
FIGS. 6A and 6B are different perspective views of a lever element of a locking lever assembly of the replacement buttstock according to the above first preferred embodiment of the present invention.
Figure 6B:
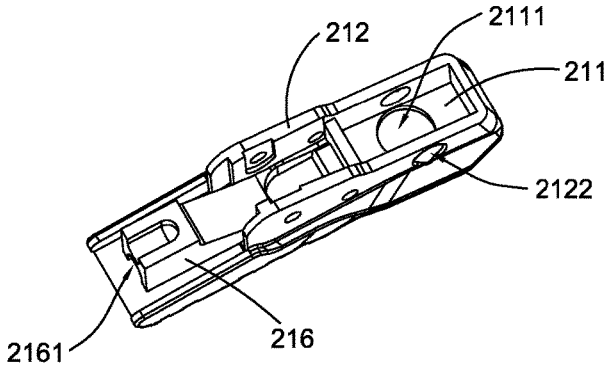
Figure 7A:
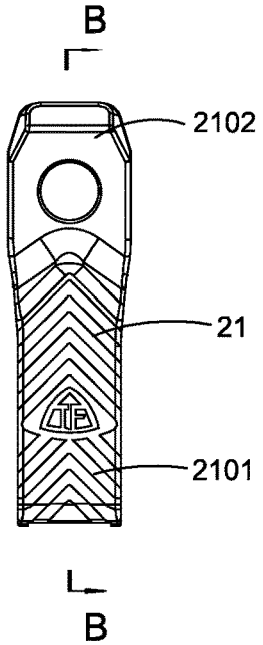
FIG. 7A is a bottom view of the lever element of the locking lever assembly of the replacement buttstock according to the above first preferred embodiment of the present invention.
Figure 7B:
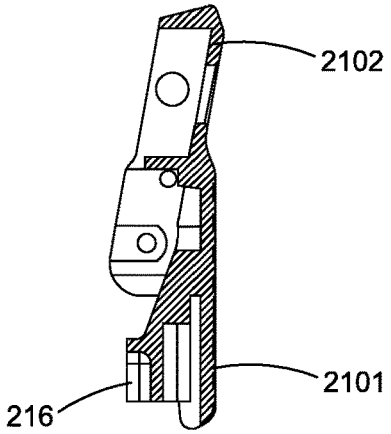
FIG. 7B is a sectional view along line B-B of FIG. 6A.
Figure 8A:
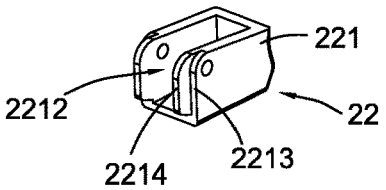
FIGS. 8A, 8B and 8C are schematic views illustrating a stopper element of the locking lever assembly of the replacement buttstock according to the above first preferred embodiment of the present invention.
Figure 8B:
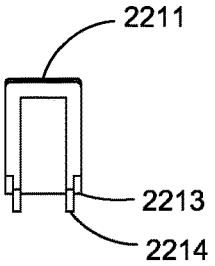
Figure 8C:
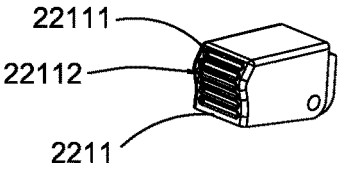

As is shown in FIG. 5C of the drawings, the mounting portion 12 comprises two side mounting plate 121 each having a side hole 122 at a middle portion thereof, the two side mounting plates 121 are spaced from each other to define an installing groove 123 for mounting the locking lever assembly 20. Each of the two mounting walls 212 has an installing hole 2122 which is aligned with the side hole 122 of each of the two side mounting plate 121 of the mounting portion 12 of the stock body 10 for each of the fixing member 214 to penetrate therethrough for fixing the rotation axle 213 to the side mounting plate 121 of the mounting portion 12 of the stock body 10.

The mounting portion 12 further has a bottom stopping surface 124 at a bottom side thereof for blocking the movement of the stopper element 22 when only the proximal end portion 2101 of the lever element 21 is pressed. More specifically, when the user uses his or her fingers to press the proximal end portion 2101 of the lever element 21, the lever element 21 rotates to drive the stopper element which is provided above the base plate 211 of the lever element 21 to simultaneously rotate, but the upward rotating movement of the stopper element 22 will be blocked by the bottom stopping surface 124 of the mounting portion 12, so that the pin body 231 of the locking pin 23 will be retained in the sliding groove 4221 to prevent the connecting extension 42 from sliding out from the receiving chamber 101 of the stock body 10. It is worth mentioning that the stopper element 22 may also be mounted to the stock body 10 in an alternative mode.

According to this preferred embodiment, in the adjusting process of the assembling position of the connecting extension 42 of the rifle 40, the stopper element 22 biasing against the bottom stopping surface 124 of the mounting portion 12 of the stock body 10 for retaining the pin body 231 of the locking pin 23 in the sliding groove 4221 of the connecting extension 42 of the rifle 40. In addition, the stopper element 22 of the instant invention is employed for enabling the assembling or disassembling of the connecting extension 42 of the rifle 40 with the replacement buttstock 100 of the present invention.

More specifically, in this preferred embodiment of the present invention, as is shown in FIG. 5C of the drawings, the mounting portion 12 of the stock body 10 further has an accommodation groove 125 which is communicated with the installing groove 123 and inwardly indented from the bottom stopping surface 124 for providing an accommodation space allowing the stopper element 22 to be inserted therein. A through hole 126 is formed at a bottom of the stock body 10, so that the engaging end portion 2311 of the pin body 231 of the locking pin 23 can be inserted into the sliding chamber 1012 of the stock body 10.

Referring to FIG. 4 and FIGS. 8A to 8C of the drawings, the stopper element 22 comprises a stopper body 221 and a reposition member 222 connected to the lever element 21. In this preferred embodiment, after the stopper body 221 is pushed at a proximal end 2211 thereof to a position which is aligned with the accommodation groove 125, the pressing operation on the proximal end portion 2101 of the lever element 21 at the bottom side thereof will drive the stopper body 221 to move into the accommodation groove 125 of the mounting portion 12 of the stock body 10. In other words, when the stopper body 221 is pushed at a proximal end 2211 thereof, the proximal end 2211 of the stopper body 221 is moved to a position beyond an edge of the bottom stopping surface 124 of the stock body 10, so that the bottom stopping surface 124 of the stock body 10 cannot block the upward rotating movement of the stopper element 121 into the accommodation groove 125 of the mounting portion 12 of the stock body 10. At that time, the pin body 231 of the locking pin 23 of the locking lever assembly 20 is moved out from the sliding groove 4221 of the connecting extension 42 of the rifle 40 and also is moved out from the sliding chamber 1012 of the stock body 10, that is to say, the engaging end portion 2311 of the pin body 231 of the locking pin 23 of the locking lever assembly 20 is no longer retained in the sliding groove 4221 of the connecting extension 42 and the sliding chamber 1012 of the stock body 10, enabling the connecting extension 42 of the rifle 40 to be slid into or slid out of the receiving chamber 101 of the stock body 10 for installing the rifle 40 with the replacement buttstock 100 or remove the replacement buttstock 100 from the rifle 40, for the pin body 231 of the locking pin 23 will no longer block the sliding movement of the engaging member 422 of the connecting extension 42 of the rifle 40.

Furthermore, when the stopper element 22 and the lever element 21 are released, the reposition member 222 will restore the stopper element 22 to its original position and the restoring element 24 will restore the lever element 21 to its original position. According to this preferred embodiment of the present invention, the reposition member 222 can be embodied as a resilient spring which is connected to the lever element 21. Accordingly, when the stopper element 22 is pushed at the proximal end 2211, the resilient spring is compressed, and when the stopper element 22 is released, the resilient spring restores to its original form so as to drive the stopper body 221 to move back to its original position.

The lever element 21 of this preferred embodiment further comprises a connecting part 216 which is provided above the base plate 211 of the lever element 21 for connecting with the reposition member 222 of the stopper element 22. More specifically, the connecting part 216 has a connecting groove 2161 for receiving the reposition member 222 which is a resilient spring and also for restricting the reposition member 22 to move in a linearly movement manner, the reposition member 222 has one end connected to the stopper body 221 and the other opposite end connected to the connecting part 216.

The stopper body 221 of the stopper element 22 has a receiving groove 2212, two end walls 2213 and two protrusion walls 2214 extended and protruded from the two end walls 2213 respectively. At least a portion of the connecting part 216 of the lever element 21 is disposed in the receiving groove 2212 of the stopper body 221 of the stopper element 22. Each of the two mounting walls 212 of the lever element 21 forms a seat portion 2124 at a proximal end thereof including an outer seating surface 21241 and an inner seating surface 21242. It is worth mentioning that when the stopper body 221 of the stopper element 22 is pushed to align with the accommodation groove 125 of the stock body 10, each of the outer seating surface 21241 of the seat portion 2124 is biasing against the corresponding end wall 2213 of the stopper body 221 and each of the inner seating surface 21242 of the seat portion 2124 is biasing against the corresponding the protrusion wall 2214 of the stopper body 221 to block the further movement of the stopper body 221.

The stopper body 221 may further comprises a restricting member 2215 connected between the two end walls 2213 at a distal end thereof, while the connecting part 215 of the lever element 21 has a restricting wall 2152. The restricting member 2215 is biasing against the restricting wall 2152 of the connecting part 215 when the locking lever assembly is in the locked state.

Figure 12D:
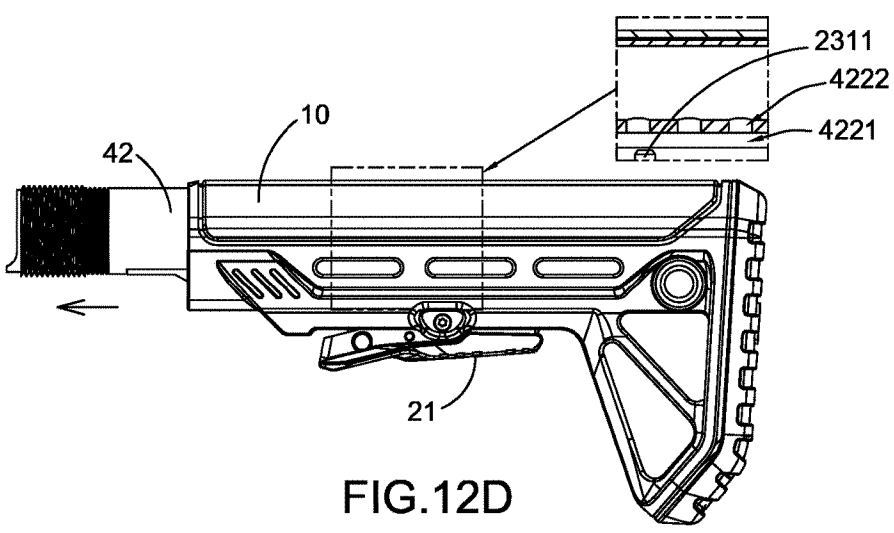
FIGS. 12A, 12B, 12C, 12D, 12E and 12F are schematic views illustrating the operation on the stopper element and the lever element of the locking lever assembly for inserting the connecting extension of the rifle into the replacement buttstock or pull the connecting extension of the rifle out of the replacement buttstock for assembling or disassembling the rifle with the replacement buttstock according to the above first preferred embodiment of the present invention.
Figure 12C:
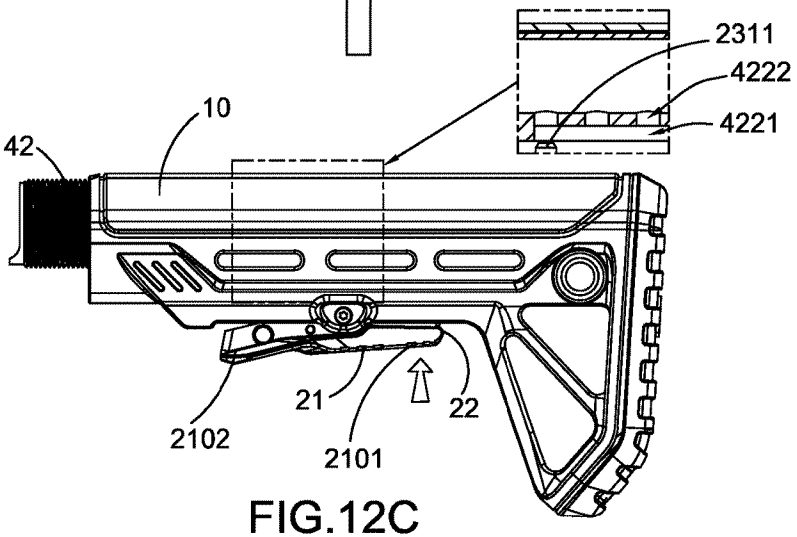
Figure 12A:
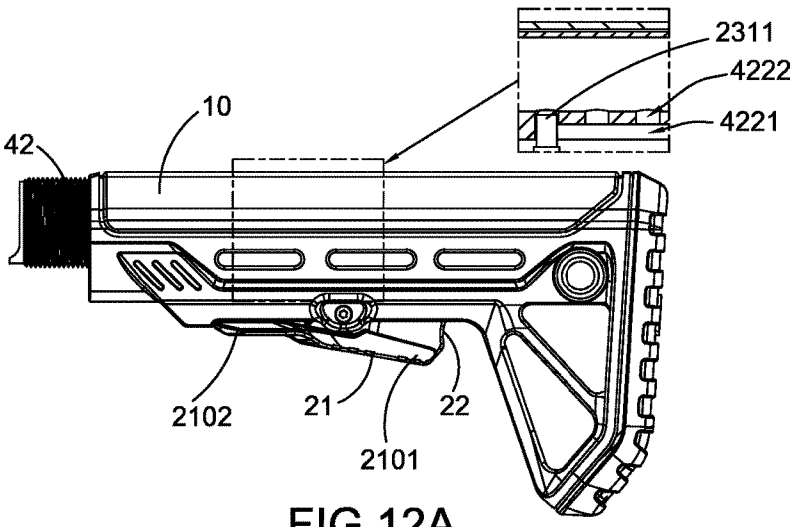
Figure 12B:
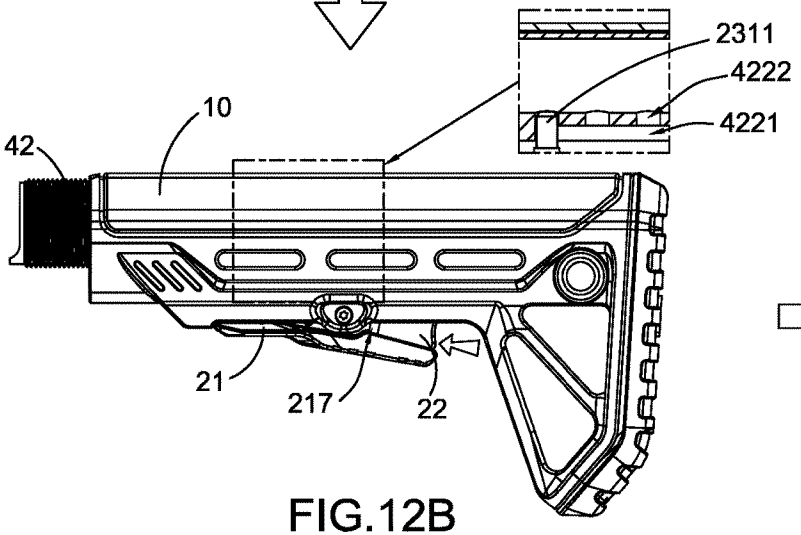
Figure 12E:
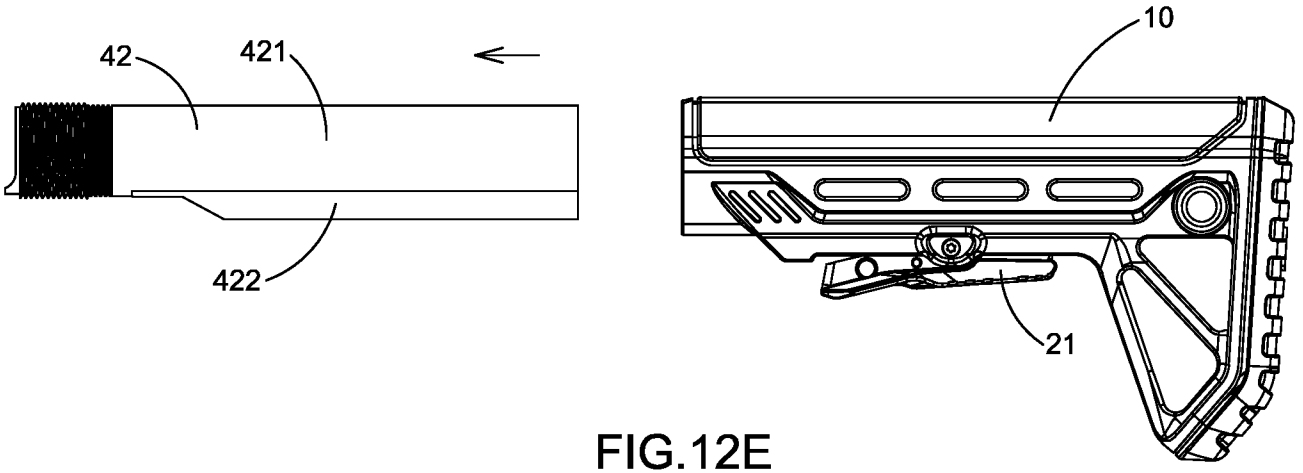
Figure 12F:
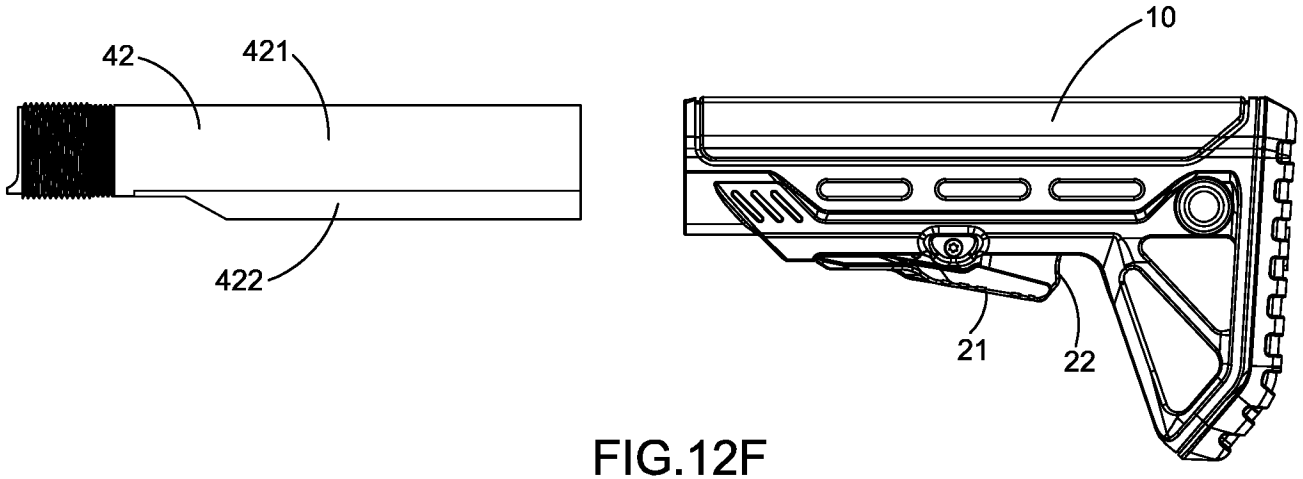
Figure 13:
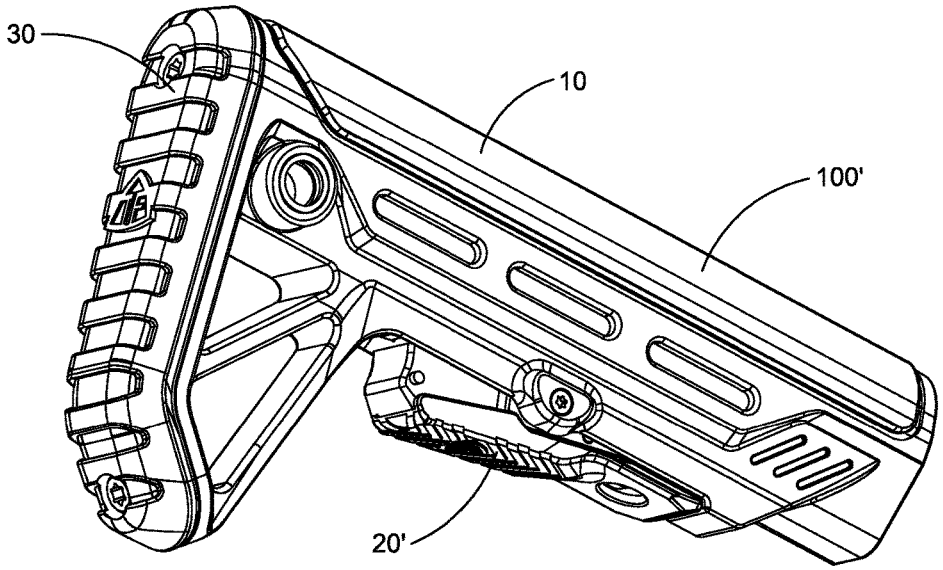
FIG. 13 is a perspective view of a replacement buttstock according to a second preferred embodiment of the present invention.
Figure 14:
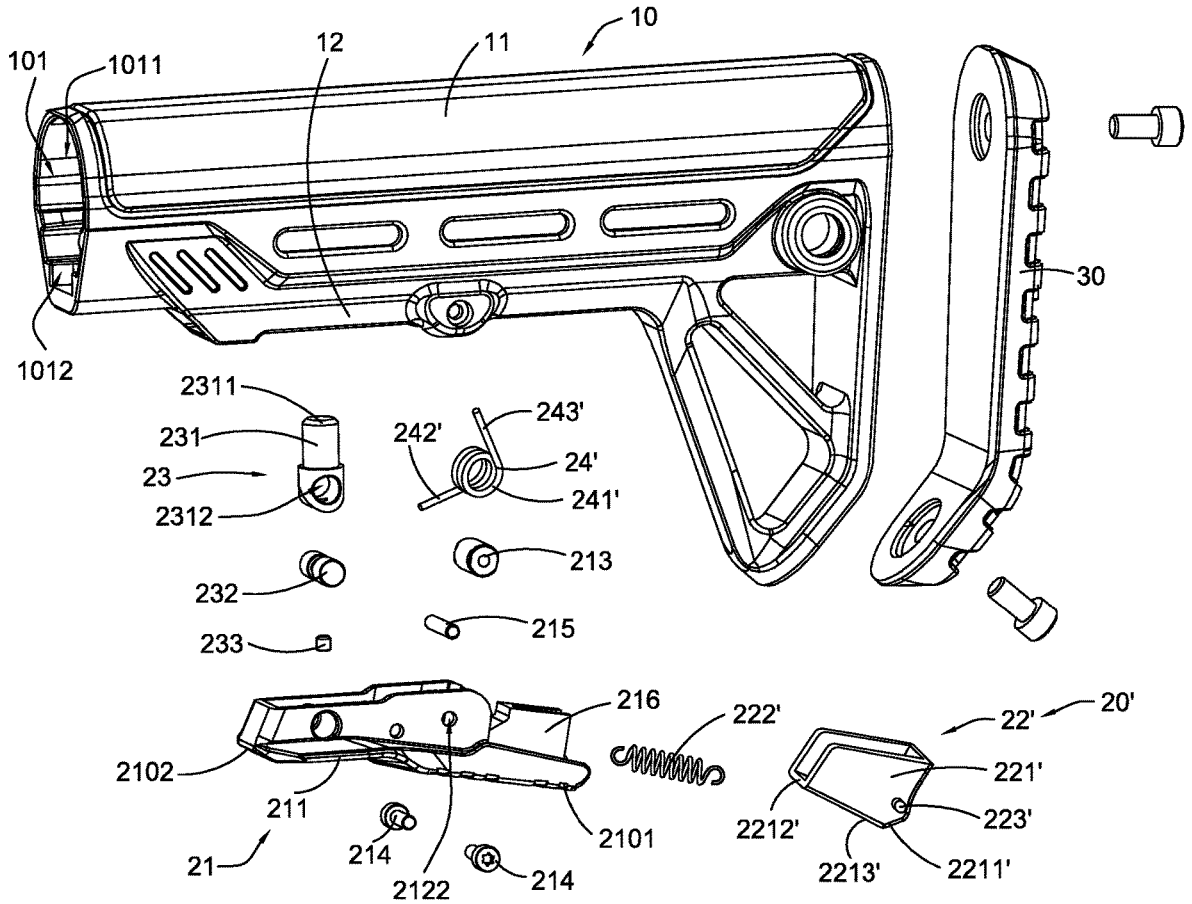
FIG. 14 is an exploded view of the replacement buttstock according to the above second preferred embodiment of the present invention.
Figure 15:
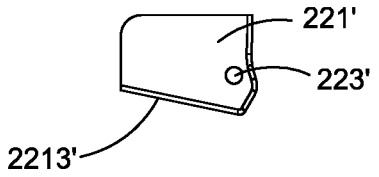
FIG. 15 is a perspective view of a stopper element of the locking lever assembly of the replacement buttstock according to the above second preferred embodiment of the present invention.
Figure 16:
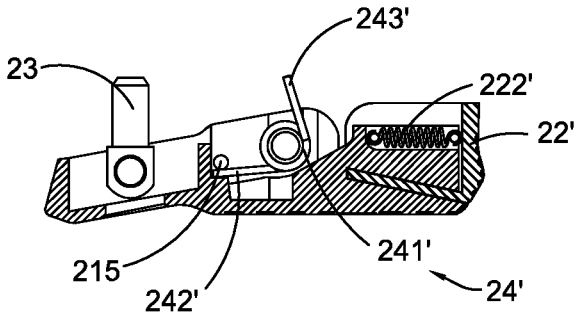
FIG. 16 is a perspective view of the assembled locking lever assembly of the replacement buttstock according to the above second preferred embodiment of the present invention.
Figure 17:
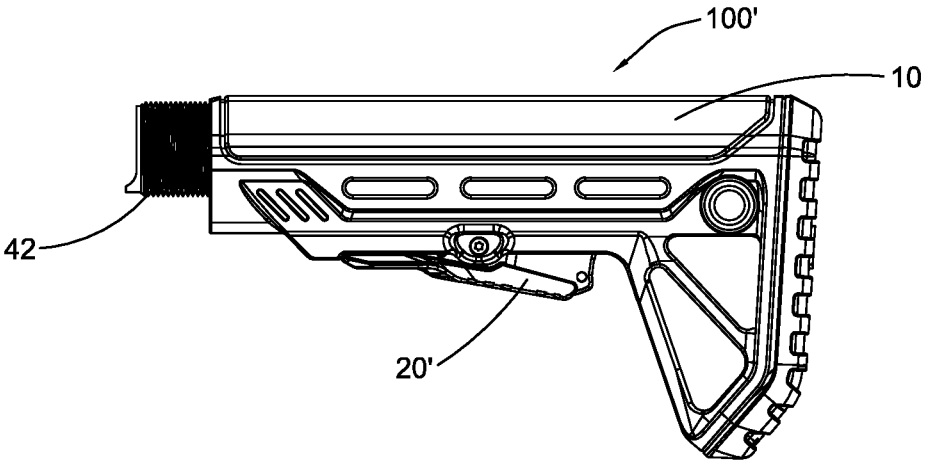
FIG. 17 is a schematic view illustrating a connecting extension being engaged with replacement buttstock according to the above second preferred embodiment of the present invention.

Accordingly, as shown in FIG. 12B of the drawings, when the stopper element 22 is at its original position, there is a slot 217 between each end wall 2213 of the stopper body 221 and the corresponding outer seating surface 21241 and a width of the slot 216 define a moving distance of the stopper body 221 above the base plate 211 of the lever element 21 as well as a compression stroke of the reposition member 222 which is a resilient spring.

Referring to FIGS. 12A to 12F of the drawings, the replacement buttstock 100 of this preferred embodiment of the instant invention is capable of shifting between three states which are a locking state in which the lever element 21 and the stopper element 22 are all at their original positions while the pin body 231 of the locking pin 23 is retained in one of the retaining grooves 4222 of the connecting extension 42 when the replacement buttstock 100 is assembled with the rifle 40, an adjusting state in which the lever element 21 is pressed to drive the stopper element 22 move to a position biasing against the bottom stopping surface 124 while the engaging end portion 2311 of the pin body 231 of the locking pin 23 is moved out from the corresponding retaining groove 4222 and is still retained in the sliding groove 4221 so that simply by sliding the connecting extension 42 in the receiving chamber 101 of the stock body 10 is able to align a new retaining groove 4222 with the pin body 231 of the locking pin 23 so that the assembling position of the connecting extension 42 in the stock body 10 is adjusted, and an unlocking state in which the stopper element 22 is longitudinally pushed at an end surface 22111 of the proximal end 2211 of the stopper body 221 of the stopper element 21 to align the stopper body 221 with an accommodation groove 125 of the stock body 10 and the lever element 21 is transversely pressed on the proximal end portion 2101 at a bottom side thereof to drive the stopper body 221 to be moved towards the accommodation groove 125 of the stock body 10 to allow at least a portion of the stopper body 221 to be inserted into the accommodation groove 125 of the stock body 10 while the lever element 21 is also rotated to drive the pin body 231 of the locking pin 23 to be moved away from the sliding groove 4221 of the connecting extension 42 and the sliding chamber 1012 of the stock body 10 so that the locking lever assembly 20 is unlocked so that the connecting extension 42 of the rifle 40 can be convenient to be inserted into the receiving chamber 101 of the stock body 10 or be removed from the receiving chamber 101 of the stock body 10 for assembling or disassembling the rifle 40 with the replacement buttstock 100 respectively.

Accordingly, when in the unlocked state, the total stopper element 22 may be inserted into the accommodation groove 125 of the stock body 10 while the lever element 21 is biasing against the bottom stopping surface 124 for preventing the further rotating movement of the lever element 21. According to this preferred embodiment, a portion of the stopper element 22 is inserted into the accommodation groove 125 of the stock body 10 while the end surface 22111 is biasing against an edge 1241 of the bottom stopping surface 124 for stopping the further movement of the stopper element 22 and the lever element 21. Accordingly, the end surface 22111 of the proximal end 2211 of the stopper body 221 of the stopper element 21 can be embodied to have a step-like configuration, an inclined surface or an arch surface for engaging with the edge 1241 of the bottom stopping surface 124 of the stock body 10. The stopper body 221 of the stopper element 21 of this preferred embodiment has one or more retaining slit 22112 in the end surface 22111 of the proximal end 2211 for engaging with the edge 1241 of the bottom stopping surface 124 of the stock body 10 when the locking lever assembly 20 is in the unlocked state.

By pushing the stopper element 22, the proximal end portion 2101 of the lever element 21 is able to move with a larger distance in the unlocked state than in the adjusting state, so that the pin body 231 of the pin 23 can be moved out of the sliding groove 4221 of the connecting extension 42 and the sliding chamber 1012 of the stock body 10.

It is thus can be seen that the replacement buttstock 100 of this preferred embodiment of the present invention is convenient and easy to be quickly installed with and removed from the rifle 40. The rifle 40 comprises the rifle body 41 including a clip 411. When a user is holding on the rifle 40 by griping the clip 411 with one hand and has adjusted to a desired aiming gesture, he or she does not have to change the desired aiming gesture if he or she wants to assemble or disassemble the replacement buttstock 100. Particularly, the user only needs to use his or her another hand to operate on the locking lever assembly 20 for moving the locking pin 23 so that the connecting extension 42 can be easy and convenient to be inserted into or slid out of the receiving chamber 101 of the stock body for quickly assemble or disassemble the rifle 40 with the detachable buttstock 100, while the hand holding on the clip 411 can be maintained at its original position for maintaining the desired aiming gesture with an original aiming direction.

Also, the user is capable of quickly getting ready for shooting by adjusting the holding position of one hand which is held on the clip 411 of the rifle 40 while simultaneously assemble the replacement buttstock 100 with the rifle 40 with the other hand.

More specifically, referring to FIGS. 12A to 12 F of the drawings, the user can use a single hand to operate on a locking lever assembly 20 of the replacement buttstock 100 for enabling the connecting extension 42 of the rifle 40 to be inserted into or slid out from the receiving chamber 101 of the stock body 10. He or she can use his or her thumb to push the stopper element 22 at the proximal end 221 thereof and use one or more fingers to press the lever element 21 on the proximal end portion 2101 at a bottom side thereof for moving the locking lever assembly 20 to the unlocked state.

Accordingly, this first preferred embodiment of the present invention provides a method for assembling the replacement buttstock 100 with the rifle 40 including the connecting extension 42, wherein the method comprises the following steps:

(a) displacing the stopper element 22 for allowing a movement of the lever element 21 when the stopper element 22 is operated by the user such as by pushing the stopper element 22 at the proximal end 2211 thereof;

(b) driving the engaging end portion 2311 of the locking pin 23 to move out of the receiving chamber 101 of the stock body 10 by the lever element 21 when the lever element 21 is pressed by the user;

(c) receiving the connecting extension 42 of the rifle 40 in the receiving chamber 101 of the stock body 10; and (d) restoring the stopper element 22 and the lever element 21 to insert the engaging end portion 2311 of the locking pin 23 into the receiving chamber 101 of the stock body 10 and retaining the connecting extension 42 of the rifle 40 in the receiving chamber 101 of the stock body 10 by the locking pin 23 when the locking lever assembly 20 is released by the user.

Accordingly, this first preferred embodiment of the present invention provides a method for disassembling the replacement buttstock 100 with the rifle 40 including the connecting extension 42, wherein the method comprises the following steps:

(A) displacing the stopper element 22 for allowing a movement of the lever element 21 when the stopper element 22 is operated by the user such as by pushing the stopper element 22 at the proximal end 2211 thereof;

(B) driving the engaging end portion 2311 of the locking pin 23 to move out of the receiving chamber 101 of the stock body 10 when the lever element 21 is pressed by the user; and (C) disengaging the locking pin 23 with the connecting extension 42 of the rifle for allowing the connecting extension 42 of the rifle 40 to be slid out of the receiving chamber 101 of the stock body 10.

According to this preferred embodiment, during the assembling and disassembling of the rifle 40 with the replacement buttstock 100 of the present invention, the user only has to conveniently operate on the locking lever assembly 20 with a relatively few effort for enabling a rotating movement of the lever element 21 of the locking lever assembly 20 for displacing the locking pin 23 so as to unlock the connecting extension 42 of the rifle 40.

When the stopper element 22 is pushed by the user for providing a moving space for the lever element 21 by receiving at least a portion of the stopper element 22 in the accommodation groove 125 of the stock body 10, the press operation on the proximal end portion of the lever element 21 of the locking lever assembly 20 will enable a rotating movement of the lever element 21 for driving the engaging end portion 2311 of the locking pin 23 at the distal end portion 2102 of the lever element 21 to move into or get out from the receiving chamber 101 of the stock body 10 so as to slid in or slide out the connecting extension 42 of the rifle 40 for assembling or disassembling the replacement buttstock 100 with the rifle 40.

Referring to FIGS. 11A to 11D of the drawings, this first preferred embodiment of the present invention further provides a method for adjusting an assembling position of the connecting extension 42 of the rifle 42 in the receiving chamber 101 of the stock body 10 of the replacement buttstock 100, wherein the method comprises the following steps:

(α) disengaging the locking pin 23 with a first retaining groove 4222 of the connecting extension 42 of the rifle 40 which is received in the receiving chamber 101 of the stock body 10 in a first assembling position when the lever element 21 is operated to displace the locking pin 23;

(β) stopping a further movement of the lever element 21 by the stopper element 22 which is driven by the lever element 21 to be moved at a position biasing against a bottom stopping surface 124 of the stock body 10 for preventing the locking pin 23 to be moved out of the receiving chamber 101 of the stock body; and (γ) engaging the locking pin 23 with a second retaining groove 4222 of the connecting extension 42 of the rifle 40 by restoring the lever element 21 to reposition the locking pin 23 after the connecting extension 42 of the rifle 40 is slid in the receiving chamber 101 of the stock body to a second assembling position which aligns the locking pin 23 with the second retaining groove 4222 of the connecting extension 42 of the rifle 40.

Therefore, the locking lever assembly 20 of this preferred embodiment of the present invention can be operated for disengaging the locking pin 23 with the connecting extension 42 so as to adjust the assembling position of the connecting extension 42 in the stock body 10 for fitting the users by adjusting a distance between the rifle 40 and a shoulder of the user, enabling the user to find a comfortable holding gesture of the rifle 40 for shooting.

Referring to FIGS. 13 to 19C of the drawings, a replacement buttstock 100' for detachably coupling with a rifle 40 comprises a rifle body 41 and a connecting extension 42 connected to the rifle body 41 according to a second preferred embodiment of the present invention is illustrated. The replacement buttstock 100' of this preferred embodiment, which has a similar structure of the detachable buttstock 100 of the above first preferred embodiment, comprises a stock body 10, a locking lever assembly 20' coupled to the stock body 10, and a stock pad 30 connected to the stock body 10.

In this preferred embodiment, similarly, the locking lever assembly 20' comprises a lever element 21, a stopper element 22', a locking pin 23, and a restoring element 24' which is embodied as a torsion spring which comprises a plurality of spring coils 241', a first biasing leg 242' and a second biasing leg 243' extended from two ends of the plurality of spring coils 241' respectively for restoring the lever element 21 when the lever element 21 is released by the user.

The stopper element 22' of this preferred embodiment comprises a stopper body 221', a reposition member 222' which is embodied as a resilient spring, and an actuator member 223' transversely extended from the stopper body 221'. The stopper body 221' has a proximal end 2211' which has a relative large height and a distal reduced portion 2212' with a relative small height so as to allow the proximal end portion 2101 of the lever element 21 to move upward for driving the locking pin 23 to displace. The stopper body 221' can be embodied to have a bottom guiding surface 2213' which can be an inclined surface, an arc surface or a step-like surface, so that the proximal end portion 2101 of the lever element 21 can slide along the bottom guiding surface 2213' and bias against the distal reduced portion 2212', so as to move with a displacement that is enough to drive the engaging end portion 2311 of the pin body 231 of the locking pin 23 to move out of the sliding chamber 1012 of the stock body 10.

In this preferred embodiment, after the stopper body 221 is pulled by holding on the actuator member 223' to a position which is aligned with the accommodation groove 125, the pressing operation on the proximal end portion 2101 of the lever element 21 at the bottom side thereof will drive the stopper body 221' to move upwardly. In other words, when the stopper body 221' is driven to move by pulling the actuator member 223' using a finger of a hand of the user, a pin body 231 of the locking pin 23 of the locking lever assembly 20 is moved out from a sliding groove 4221 of the connecting extension 42 of the rifle 40 and also is moved out from a sliding chamber 1012 of the stock body 10, that is to say, the engaging end portion 2311 of the pin body 231 of the locking pin 23 of the locking lever assembly 20 is no longer retained in the sliding groove 4221 of the connecting extension 42 and the sliding chamber 1012 of the stock body 10, enabling the connecting extension 42 of the rifle 40 to be slid into or slid out of the receiving chamber 101 of the stock body 10 for installing the rifle 40 with the replacement buttstock 100' or remove the replacement buttstock 100' from the rifle 40, for the pin body 231 of the locking pin 23 will no longer block the sliding movement of the engaging member 422 of the connecting extension 42 of the rifle 40.

Furthermore, when the stopper element 22' and the lever element 21 are released, the reposition member 222' will restore the stopper element 22' to its original position and the restoring element 24' will restore the lever element 21 to its original position. According to this preferred embodiment of the present invention, the reposition member 222' can be embodied as a resilient spring which is connected to the lever element 21. Accordingly, when the stopper element 22' is pulled at the actuator member 223', the resilient spring is stretched, and when the stopper element 22' is released, the resilient spring restores to its original form so as to drive the stopper body 221' to move back to its original position.

Accordingly, the replacement buttstock 100' of this preferred embodiment of the instant invention is capable of shifting between three states which are a locking state in which the lever element 21 and the stopper element 22' are all at their original positions while the pin body 231 of the locking pin 23 is retained in one of the retaining grooves 4222 of the connecting extension 42 when the replacement buttstock 100' is assembled with the rifle 40, an adjusting state in which the lever element 21 is pressed to drive the stopper element 22' move to a position biasing against the bottom stopping surface 124 while the engaging end portion 2311 of the pin body 231 of the locking pin 23 is moved out from the corresponding retaining groove 4222 and is still retained in the sliding groove 4221 so that simply by sliding the connecting extension 42 in the receiving chamber 101 of the stock body 10 is able to align a new retaining groove 4222 with the pin body 231 of the locking pin 23 so that the assembling position of the connecting extension 42 in the stock body 10 is adjusted, and an unlocking state in which the actuator member 223' of the stopper element 22' is longitudinally pulled to drive stopper body 221' of the stopper element 21' to longitudinally move to align the distal reduced portion 2212' with the proximal end portion 2101 of the lever element 21 and the lever element 21 is transversely pressed on the proximal end portion 2101 at a bottom side thereof to bias against the distal reduced portion 2212' of the stopper element 22' while the lever element 21 is also rotated to drive the pin body 231 of the locking pin 23 to be moved away from the sliding groove 4221 of the connecting extension 42 and the sliding chamber 1012 of the stock body 10 so that the locking lever assembly 20' is unlocked so that the connecting extension 42 of the rifle 40 can be convenient to be inserted into the receiving chamber 101 of the stock body 10 or be removed from the receiving chamber 101 of the stock body 10 for assembling or disassembling the rifle 40 with the replacement buttstock 100' respectively.

By pulling the stopper element 22', the proximal end portion 2101 of the lever element 21 is able to move with a larger distance in the unlocked state than in the adjusting state, so that the pin body 231 of the pin 23 can be moved out of the sliding groove 4221 of the connecting extension 42 and the sliding chamber 1012 of the stock body 10.

According to this embodiment, the stopper element 22' is mounted to the lever element 21, while as is shown in FIGS. 20 to 24C of the drawings, according to an alternative mode of the second preferred embodiment, a stopper element 22' may be mounted to the stock body 10 by the reposition member 222" so that when the stopper element 22' is longitudinally moved by pushing or pulling, the stopper element 22' will not block the movement of the lever element 21 so that the lever element 21 is able to be moved to the unlocked state. In the locked state, a gap 224' is formed between the proximal end portion 2101 of the lever element 21 and the stopper element 22', so that when the proximal end portion 2101 of the lever element 21 is moved to the adjusting state, a bottom stopping surface 124' which is formed on the stopper element 22" will block the further movement of lever element 21. While in the unlocked state, the proximal end portion 2101 of the lever element 21 is upwardly moved beyond the bottom stopping surface 124'.

Figure 19A:
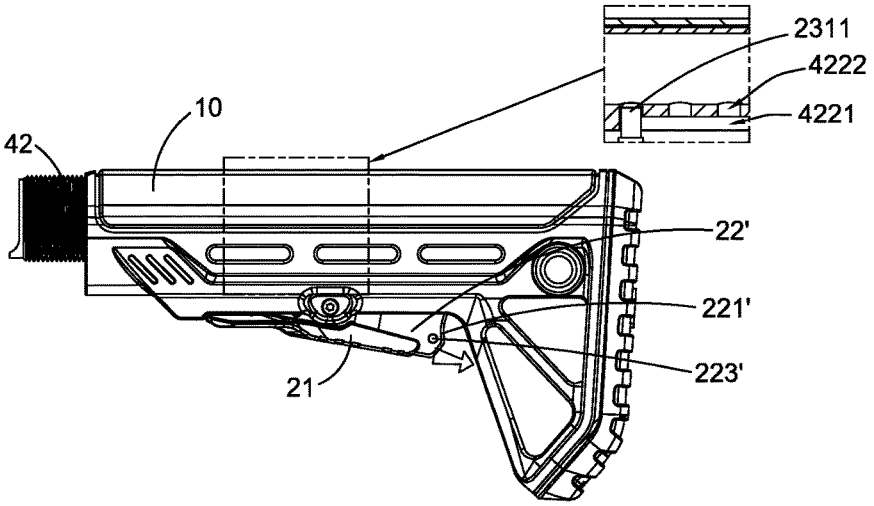
FIGS. 19A, 19B, and 19C are schematic views illustrating the operation on the stopper element and the lever element of the locking lever assembly for inserting the connecting extension of the rifle into the replacement buttstock or pull the connecting extension of the rifle out of the replacement buttstock for assembling or disassembling the rifle with the replacement buttstock according to the above second preferred embodiment of the present invention.
Figure 19B:
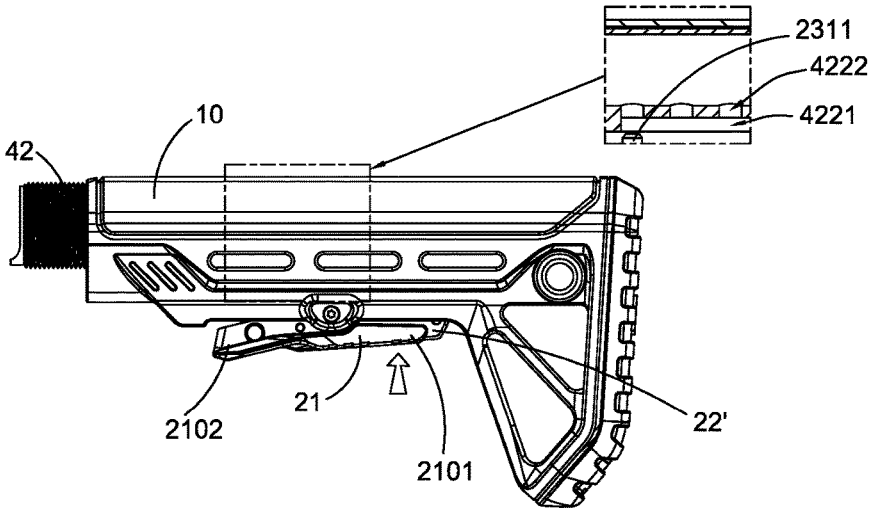
Figure 19C:
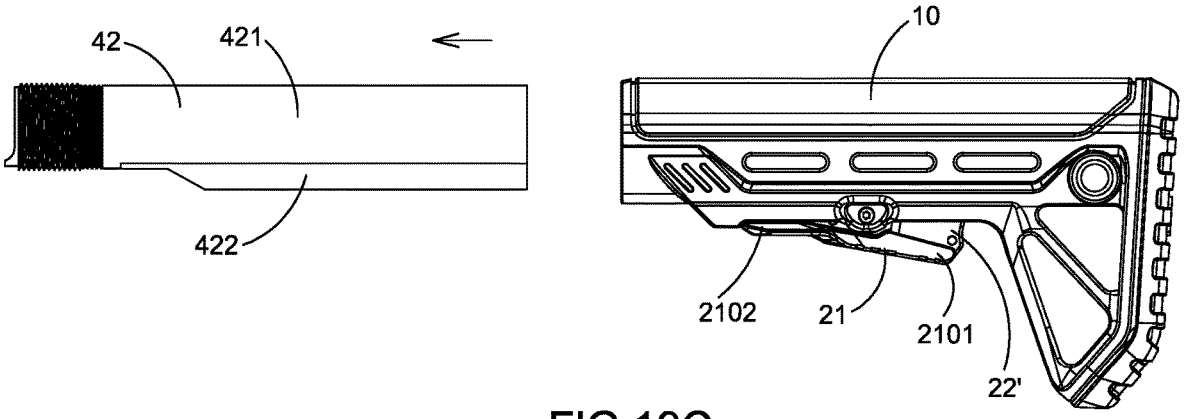
Figure 20:
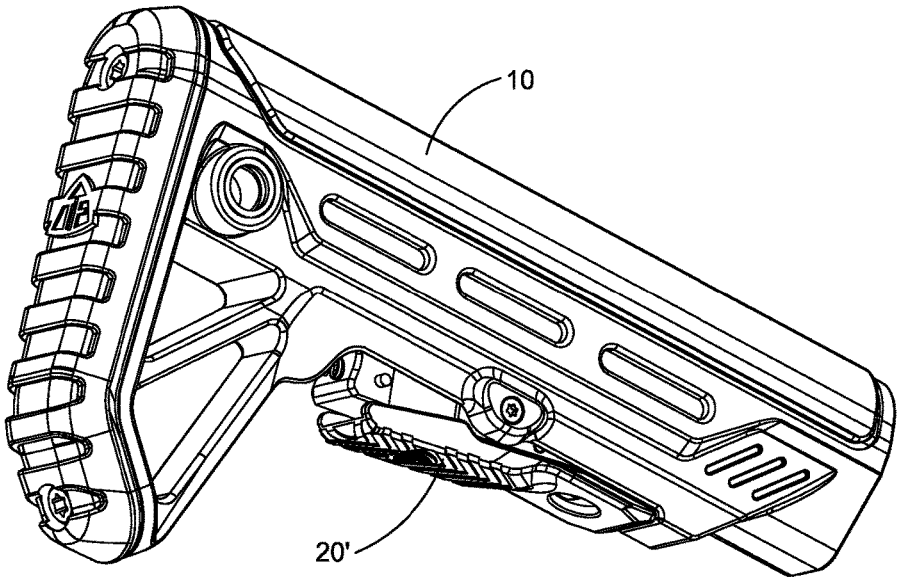
FIG. 20 is a perspective view of a replacement buttstock according to an alternative mode of the above second preferred embodiment of the present invention.
Figure 21:
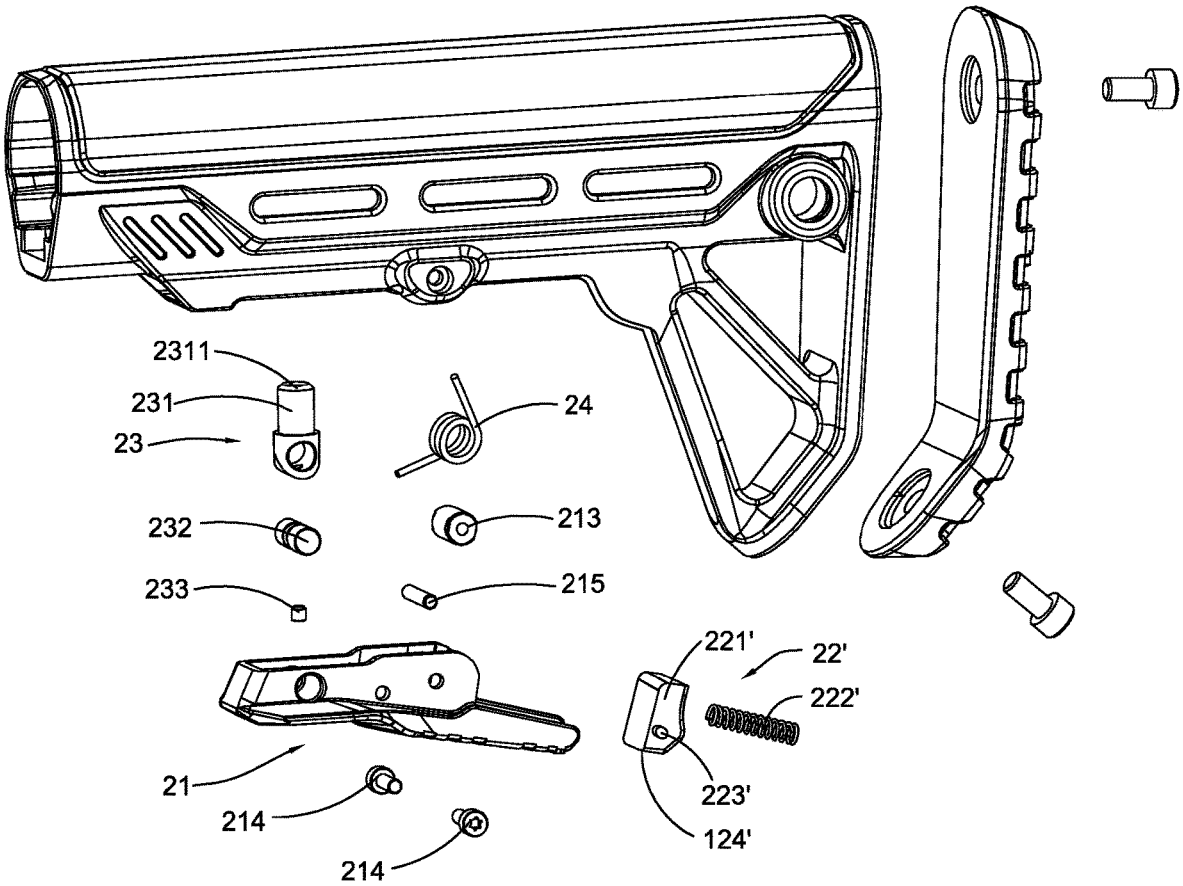
FIG. 21 is an exploded view of the replacement buttstock according to the above second preferred embodiment of the present invention.
Figure 22:
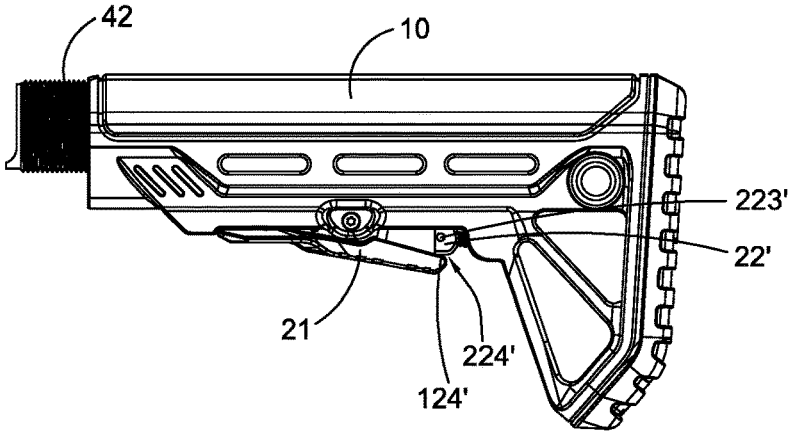
FIG. 22 is a schematic view illustrating a connecting extension being engaged with replacement buttstock according to the above second preferred embodiment of the present invention.
Figure 23A:
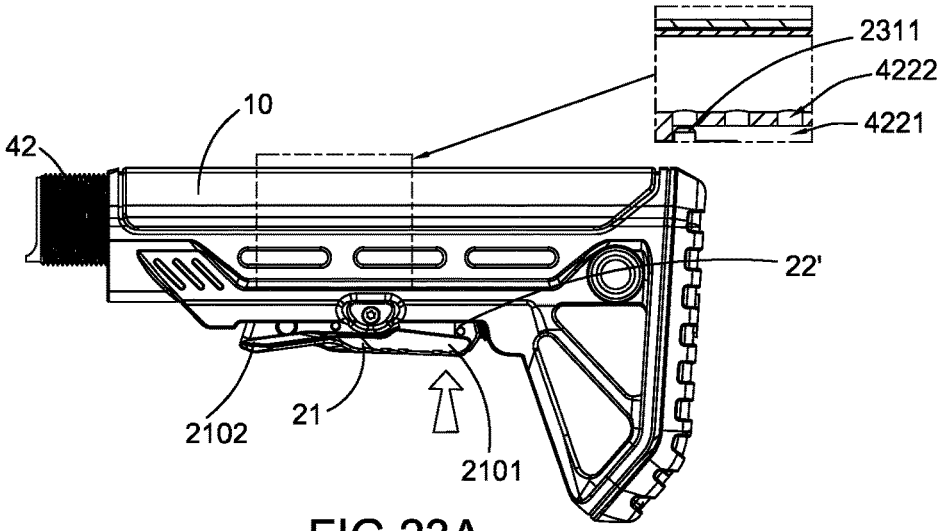
FIGS. 23A and 23B are schematic views illustrating the operation on the lever element for adjusting the engaging position of the connecting extension with a locking pin of the replacement buttstock according to the above second preferred embodiment of the present invention.
Figure 23B:
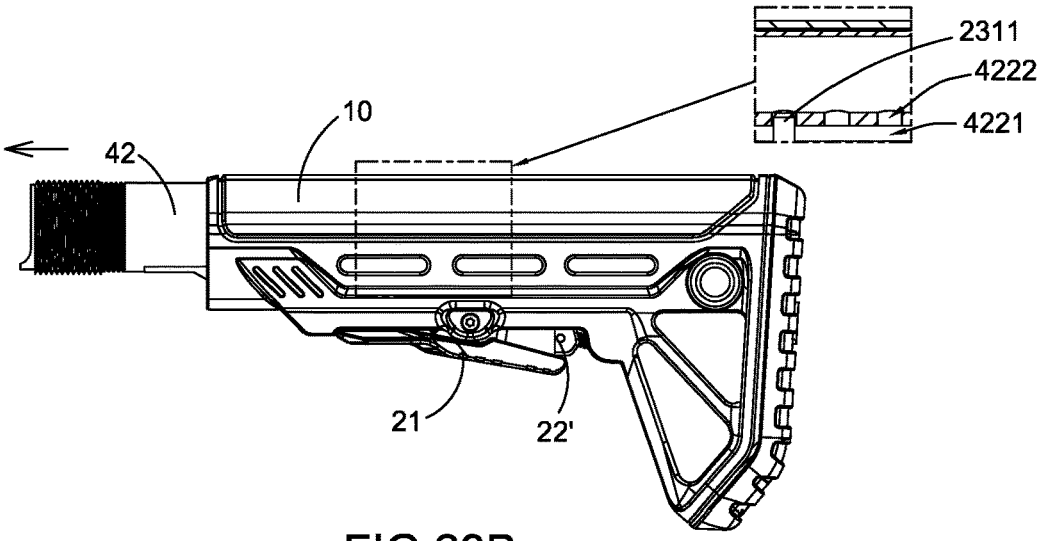
Figure 24A:
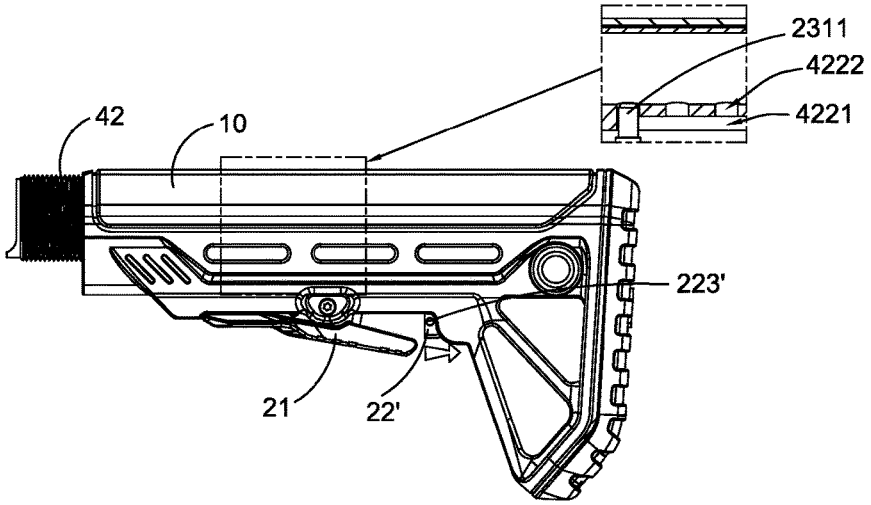
FIGS. 24A, 24B, and 24C are schematic views illustrating the operation on the stopper element and the lever element of the locking lever assembly for inserting the connecting extension of the rifle into the replacement buttstock or pull the connecting extension of the rifle out of the replacement buttstock for assembling or disassembling the rifle with the replacement buttstock according to the above second preferred embodiment of the present invention.
Figure 24B:
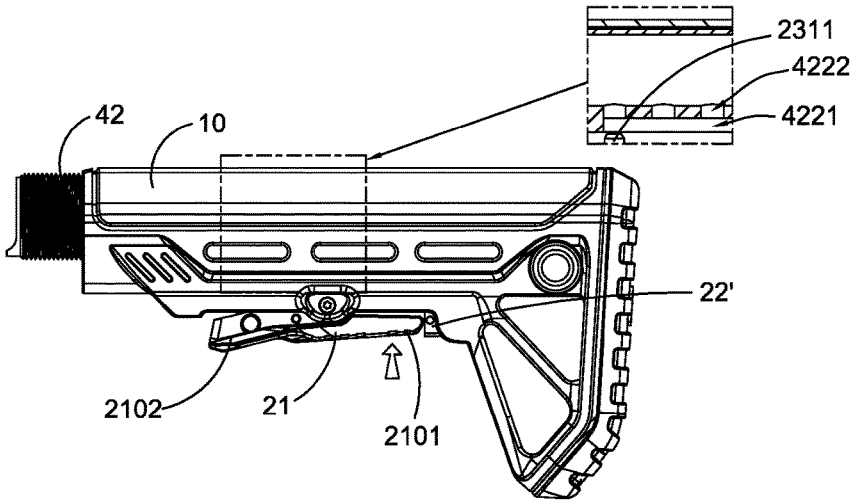
Figure 24C:
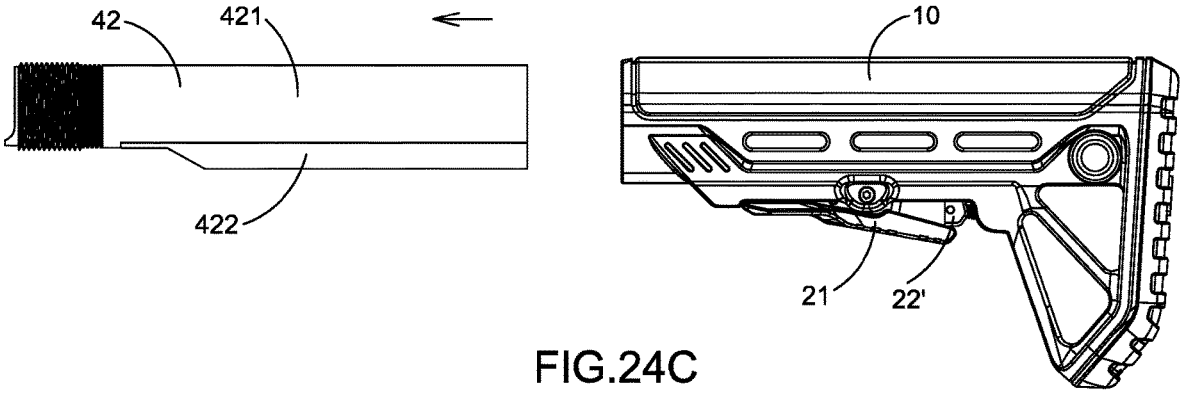

Accordingly, referring to FIGS. 19A to 19C of the drawings, this preferred embodiment of the present invention provides a method for assembling the replacement buttstock 100 with the rifle 40 including the connecting extension 42, wherein the method comprises the following steps:

(a) displacing the stopper element 22' for allowing a movement of the lever element 21 when the stopper element 22' is operated by the user such as by pulling the actuator member 223' of the stopper element 22';

(b) driving the engaging end portion 2311 of the locking pin 23 to move out of the receiving chamber 101 of the stock body 10 by the lever element 21 when the lever element 21 is pressed by the user;

(c) receiving the connecting extension 42 of the rifle 40 in the receiving chamber 101 of the stock body 10; and (d) restoring the stopper element 22' and the lever element 21 to insert the engaging end portion 2311 of the locking pin 23 into the receiving chamber 101 of the stock body 10 and retaining the connecting extension 42 of the rifle 40 in the receiving chamber 101 of the stock body 10 by the locking pin 23 when the locking lever assembly 20 is released by the user.

Accordingly, this second preferred embodiment of the present invention provides a method for disassembling the replacement buttstock 100 with the rifle 40 including the connecting extension 42, wherein the method comprises the following steps:

(A) displacing the stopper element 22' for allowing a movement of the lever element 21 when the stopper element 22' is operated by the user such as by pulling the actuator member 223' of the stopper element 22';

(B) driving the engaging end portion 2311 of the locking pin 23 to move out of the receiving chamber 101 of the stock body 10 when the lever element 21 is pressed by the user; and (C) disengaging the locking pin 23 with the connecting extension 42 of the rifle for allowing the connecting extension 42 of the rifle 40 to be slid out of the receiving chamber 101 of the stock body 10.

When the stopper element 22' is pulled by the user for providing a moving space for the lever element 21 by aligning the distal reduced portion 2212' with a relatively small height with the proximal end portion of the lever element 21 or just moving away the stopper element 22' so that the stopper element 22' is not above the lever element 21 to stop the movement of the lever element 21, the press operation on the proximal end portion of the lever element 21 of the locking lever assembly 20 will enable a rotating movement of the lever element 21 for driving the engaging end portion 2311 of the locking pin 23 at the distal end portion 2102 of the lever element 21 to move into or get out from the receiving chamber 101 of the stock body 10 so as to slid in or slide out the connecting extension 42 of the rifle 40 for assembling or disassembling the replacement buttstock 100 with the rifle 40.

Figure 18A:
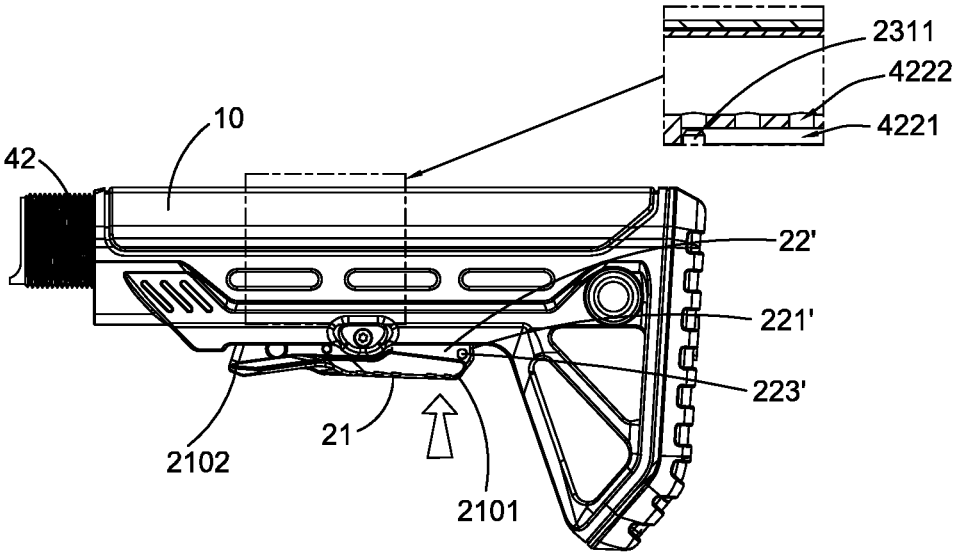
FIGS. 18A and 18B are schematic views illustrating the operation on the lever element for adjusting the engaging position of the connecting extension with a locking pin of the replacement buttstock according to the above second preferred embodiment of the present invention.
Figure 18B:
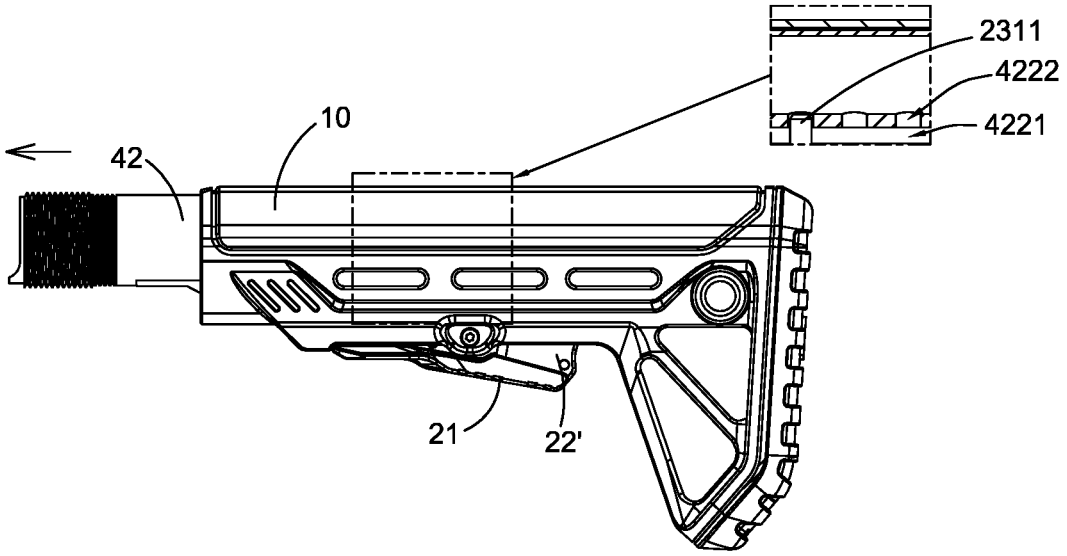

Referring to FIG. 18A to 18B of the drawings, the second embodiment of the present invention further provides a method for adjusting an assembling position of the connecting extension 42 of the rifle 42 in the receiving chamber 101 of the stock body 10 of the replacement buttstock 100, wherein the method comprises the following steps:

(α) disengaging the locking pin 23 with a first retaining groove 4222 of the connecting extension 42 of the rifle 40 which is received in the receiving chamber 101 of the stock body 10 in a first assembling position when the lever element 21 is operated to displace the locking pin 23;

(β) stopping a further movement of the lever element 21 by the stopper element 22' which is driven by the lever element 21 to be moved at a position biasing against a bottom stopping surface 124 of the stock body 10 or a bottom stopping surface 124' of the stopper element 22' for preventing the locking pin 23 to be moved out of the receiving chamber 101 of the stock body; and (γ) engaging the locking pin 23 with a second retaining groove 4222 of the connecting extension 42 of the rifle 40 by restoring the lever element 21 to reposition the locking pin 23 after the connecting extension 42 of the rifle 40 is slid in the receiving chamber 101 of the stock body to a second assembling position which aligns the locking pin 23 with the second retaining groove 4222 of the connecting extension 42 of the rifle 40.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A replacement buttstock for a rifle including a connecting extension, comprising:

a stock body having an elongated receiving chamber for receiving the connecting extension; and a locking lever assembly coupled to said stock body, comprising:

a lever element;

a locking pin connected to said lever element for retaining the connecting extension in said receiving chamber of said stock body;

a stopper element, wherein said stopper element is arranged for being operated to allow said lever element which is being pressed to move to an unlock state in which said locking pin is driven to move out of said receiving chamber of said stock body by said lever element for unlocking the connecting extension; and a restoring element for restoring said lever element when said lever element is released, wherein said stopper element comprises a stopper body and a reposition member connected between said stopper body and said lever element for restoring said stopper body when said stopper element is released, wherein said stock body has an accommodation groove, wherein said stopper body has an end surface at a proximal end thereof, wherein when said end surface of said stopper body is longitudinally pushed, said lever element being pressed drives at least a portion of said stopper body to move into said accommodation groove and drives said locking pin to move out of said receiving chamber of said stock body, wherein said stock body has a bottom stopping surface, wherein said locking pin has an engaging end portion, wherein when said stopper element is not pushed while said lever element is pressed to be moved to an adjusting state for adjusting an assembling position of the connecting extension, said lever element drives said stopper body to move to a position biasing against said bottom stopping surface for blocking a further movement of said lever element so as to retain said engaging end portion of said locking pin in said receiving chamber for preventing the connecting extension from sliding out of said receiving chamber of said stock body, wherein said lever element comprises a base plate and a connecting part provided above said base plate, wherein said connecting part has a connecting groove receiving said reposition member which is a resilient spring, wherein said lever element further comprises two mounting walls extended from said base plate, wherein said stopper body has a receiving groove, two end walls and two protrusion walls extended and protruded from said two end walls respectively, wherein at least a portion of said connecting part of said lever element is disposed in said receiving groove of said stopper body of said stopper element, wherein each of said two mounting walls of said lever element forms a seat portion at a proximal end thereof including an outer seating surface and an inner seating surface, wherein when said stopper body of said stopper element is pushed to align with said accommodation groove of said stock body, each of said outer seating surface of said seat portion is biasing against said corresponding end wall of said stopper body and each of said inner seating surface of said seat portion is biasing against said corresponding said protrusion wall of said stopper body.

* * * * *